US006933479B2

(12) United States Patent
Tanaka et al.

(10) Patent No.: US 6,933,479 B2
(45) Date of Patent: Aug. 23, 2005

(54) INDUCTION HEATING ROLLER APPARATUS AND IMAGE FORMATION APPARATUS

(75) Inventors: Takaaki Tanaka, Kanagawa-ken (JP); Toshiya Suzuki, Kanagawa-ken (JP); Takayuki Ogasawara, Kanagawa-ken (JP); Ichiro Yokozeki, Kanagawa-ken (JP); Manabu Kika, Kanagawa-ken (JP)

(73) Assignee: Harison Toshiba Lighting Corp., Imabari (JP)

( * ) Notice: Subject to any disclaimer, the term of this patent is extended or adjusted under 35 U.S.C. 154(b) by 0 days.

(21) Appl. No.: 10/394,057

(22) Filed: Mar. 24, 2003

(65) Prior Publication Data

US 2003/0213799 A1 Nov. 20, 2003

(30) Foreign Application Priority Data

Mar. 27, 2002 (JP) ..... 2002-088914
May 21, 2002 (JP) ..... 2002-146454
May 24, 2002 (JP) ..... 2002-151164

(51) Int. Cl.[7] ..... H05B 6/14
(52) U.S. Cl. ..... 219/619; 399/328
(58) Field of Search ..... 219/619, 622, 219/646, 656, 632, 667, 670, 671; 399/113, 328, 329, 330

(56) References Cited

U.S. PATENT DOCUMENTS 5,752,150 A * 5/1998 Kato et al. ..... 399/330
5,991,569 A * 11/1999 Sugihara et al. ..... 399/113
6,298,215 B1 10/2001 Nomura et al.
6,336,027 B1 1/2002 Sakai et al.
6,573,485 B2 6/2003 Yokozeki et al.
6,725,000 B2 4/2004 Takaji et al.
2002/0125244 A1 9/2002 Yokozeki et al.
2003/0000943 A1 1/2003 Yokozeki
2003/0198481 A1 10/2003 Sakai
2003/0213799 A1 11/2003 Tanaka et al.
2004/0005176 A1 1/2004 Yokozeki et al.

FOREIGN PATENT DOCUMENTS

JP 59-33787 2/1984
JP 07234599 A * 9/1995 ..... G03G/15/20
JP 2000-215971 8/2000
JP 2000-215974 8/2000
JP 2001-16335 1/2001
JP 2002164159 A * 6/2002 ..... H05B/6/14
JP 2002-229355 8/2002

* cited by examiner

*Primary Examiner*—Quang T. Van
(74) *Attorney, Agent, or Firm*—Finnegan, Henderson, Farabow, Garrett & Dunner, L.L.P.

(57) ABSTRACT

An induction heating roller apparatus has a heating roller for generating heat with an induction current by being magnetically coupled to an induction coil, and a plurality of induction coils placed in a dispersed state in an axial direction inside the heating roller and also set such that adjacent heating rollers are in mutually reversed winding directions so that generated flux has the same polarity. A high frequency power supply is provided for supplying high frequency power to the plurality of induction coils.

6 Claims, 24 Drawing Sheets

(PRIOR ART)

INDUCTION HEATING ROLLER APPARATUS AND IMAGE FORMATION APPARATUS

BACKGROUND OF THE INVENTION

1. Field of the Invention

The present invention relates to an induction heating roller apparatus and to an image formation apparatus, which are provided with the fixing apparatus.

2. Description of the Prior Art

Heating rollers, which employ halogen lamps as heat sources, are used in the prior art to thermally fix a toner image. However, the halogen lamp heat sources are inefficient and require a large amount of power. Accordingly, a technique involving induction heating is being developed to solve such problems.

Japanese Laid-Open Patent Publication No. 2000-215974 describes an exciting coil, which is arranged near a heated object. The exciting coil generates an induction current in the heated object, which is a magnetic heating roller. The exciting coil is formed by winding a coil in a planar manner along a curved surface of the heated object. A magnetic core is arranged along the curved surface or the exciting coil on the side opposite to the heated object at the longitudinal ends of the exciting coil (first prior art example).

Japanese Laid-Open Patent publication No. 2000-215971 describes an induction heating apparatus having a heating rotor, or heating roller, which generates heat by means of electromagnetic induction, and a magnetic flux generating means, which is arranged in the heating rotor. The magnetic flux generating means includes a magnetic core and an electromagnetic conversion coil, which is wound about the core. The magnetic core includes a core portion, about which the electromagnetic conversion coil is wound, and a magnetic flux induction core portion. The magnetic flux induction core portion, which has a magnetic gap between its distal ends, concentrates magnetic flux at part of a heating rotor rather than the core portion (second prior art example).

The first and second prior art examples employ a heating technique that uses eddy current loss (hereafter referred to as eddy current loss technique). Such heating technique works under the same principle as that applied to IH jars. The frequencies of the high frequency employed in the eddy current loss technique is about 20 to 100 kHz.

In comparison, Japanese Laid-Open Patent Publication No. 59-33787 describes a high frequency induction heating roller. The high frequency induction heating roller includes a cylindrical roller body, or heating roller, which is formed by a conductive member, a cylindrical bobbin, which is arranged in the roller body in concentricity with the roller body, and an induction coil, which is spirally wound about the periphery of the bobbin. When current flows through induction coil, the induction coil, which induces induction current in the roller body, is heated (third prior art example).

In the third prior art example, the cylindrical roller body functions as a secondary coil, which is a closed circuit, and the induction coil functions as a primary coil. This causes transformer coupling between the primary and secondary coils and induces a secondary voltage in the secondary coil of the cylindrical roller body. Based on the secondary voltage, a secondary current flows in the closed circuit of the secondary coil. This is a heating technique (hereafter referred to as a transformer technique) that heats a secondary resistor, which heats the cylindrical roller body. The transformer technique, which has a high stationary efficiency since its magnetic coupling is stronger than the eddy current loss technique, entirely heats the heating roller. Thus, the transformer technique is advantageous in that is simplifies the structure of a fixing apparatus in comparison to the first and second prior art examples. Further, when the operational frequency is 100 kHz or greater, and preferably a high frequency of 1 MHz or greater, the Q of the induction coil may he increased to increase the power transmission efficiency. This increases the total heating efficiency and reduces power consumption. Further, the heat capacity is much smaller than that of the eddy current loss technique. Accordingly, the transformer technique is preferable for increasing the speed of thermal fixing.

The inventors have invented a transformer coupling technique that efficiently heats the heating roller. In the transformer coupling technique, by forming a closed circuit, the secondary reactance of which is substantially equal to a secondary resistance of the heating roller that is air-core transformer coupled to an induction coil, the efficiency for transmitting power from the induction coil to the heating roller increases. This efficiently heats the heating roller. An application for a patent for this invention was applied for in Japanese Patent Application No. 2001-016335. The invention reduces power consumption for induction heating of the heating roller and facilitates increasing the speed of thermal fixing.

In an image formation means, such as a copy machine or a printer, paper on which images are formed is selected from multiple sizes. To cope with such function, the heating area of the heating roller must be changed in accordance with the paper size.

As for the trans-method, it is possible to render the heating area of the heating roller changeable in the axial direction by placing a plurality of the induction coils in a dispersed state in the axial direction of the heating roller and selectively driving the induction coils as a suitable configuration of the induction coils for the heating roller. It is thereby possible to meet the requirement and heat only a necessary area so as to avoid wasteful power consumption.

In the case of the fixing apparatus using the heating roller, however, it is necessary, for the sake of fusion-binding toner on paper, to manage it so as to implement even temperature distribution in which temperature anomaly of the heating roller is within plus or minus 15 degrees C.

Thus, as shown in FIG. 24A, if a plurality of induction coils 102 are placed with spacing among themselves inside a heating roller 101 and are energized by a high frequency source (not shown), the induction current runs in the closed circuit of the secondary coil of the heating roller 101 which is then heated. And the heating roller 101 at this time shows a temperature distribution characteristic as shown in FIG. 24B. As for FIG. 24B, the horizontal axis shows a position of the heating roller and the vertical axis shows the temperature respectively. As shown in the drawing, the point indicated by a symbol a in the drawing at which the induction coil is placed shows a high temperature, whereas the point equivalent to the spacing between the induction coils is at a temperature b which is lower than the high temperature a. An induction heating coil apparatus having such temperature distribution shows the temperature distribution characteristic far better than that of the induction heating coil apparatus in the past. However, there remains a room for further improvement in order to implement the induction heating coil apparatus having the even temperature distribution which is satisfactory.

In order to solve the temperature anomaly of the heating roller 101, it is thinkable to place the induction coils 102 in the proximity. However, the traders generally think that, if the induction coils 102 are placed in the proximity, a considerable portion of the flux generated from the induction coils 102 interlinks with the adjacent induction coils 103 so that, as the power transmission efficiency from the induction coil to the heating roller becomes lower, a high power transmission efficiency cannot be obtained. Therefore, when adjacently placing the plurality of induction coils 102 which are individually energized, they are not placed in sufficient proximity.

For the above reason, appearance of the induction heating roller apparatus having solved the problem of the evenness of the temperature distribution in the heating roller 101 is eagerly desired.

Nevertheless, in the case of placing the plurality of induction coils in a dispersed state in the axial direction of the heating roller, there are the following problems in addition to the above-mentioned problem of the evenness of the temperature distribution. To be more specific, there arises a significant potential difference between the adjacent induction coils so that it is necessary to provide a predetermined insulation distance between a pair of the adjacent induction coils according to the potential differences between them. This problem of the electric insulation distance is also a reason that it is difficult to shorten the spacing between the induction coils.

As the induction coils and the high frequency power supply are generally placed at positions with spacing among them, they are connected via electric supply lines. Therefore, it is necessary to adequately perform insulation not only between the induction coils but also mutually between the electric supply lines and between the electric supply line and the induction coil.

Furthermore, to selectively drive the plurality of induction coils, it is necessary to connect each of the induction coils to the high frequency power supply independently of one another. For that reason, it becomes difficult to secure the electric insulation distance among a plurality of the electric supply lines extended from each high frequency power supply.

To summarize the above, each of the requirements described above must be satisfied in order to evenly heat the heating roller in its axial direction and render the heating area switchable. However, it was difficult for the related arts in the past to meet all the requirements.

SUMMARY OF THE INVENTION

An object of the present invention is to provide an induction heating roller apparatus capable of evenly heating a heating roller along an axial direction and an image formation apparatus having it.

Another object of the present invention is to provide the induction heating roller apparatus wherein it is easy to perform insulation among a plurality of induction coils placed in a dispersed state and the image formation apparatus having it.

A further object of the present invention is to provide the induction heating roller apparatus capable of evenly heating the heating roller in the axial direction and easily insulating electric supply lines connected to the plurality of induction coils placed in the dispersed state and the image formation apparatus having it.

A still further object of the present invention is to provide the induction heating roller apparatus capable of switching a heating area of the heating roller and the image formation apparatus having it.

The induction heating roller apparatus according to the present invention has the heating roller, a plurality of induction coils and a high frequency power supply, wherein the plurality of induction coils are placed in a dispersed state in the axial direction inside the heating roller, and are also set in a relationship in which adjacent ones are in mutually reversed winding directions and generated flux has the same polarity.

According to the present invention, the "induction coil" is means for interlinking a magnetic field generated therefrom with the heating roller and inducing a secondary current to the heating roller and also generating resistance heating so as to heat the heating roller as required, and a plurality of them are placed in the dispersed state in the axial direction inside the heating roller. The plurality of induction coils need to be placed to have the flux generated in the same direction against the axis so that mainly an area of the heating roller directly facing the induction coils can be effectively heated by the flux generated therefrom respectively. And they are driven, or in other words energized, that is, excited directly from a high frequency power supply mentioned later or by way of a matching circuit or a high frequency transmission line and magnetically coupled, that is, air-core-transfer-coupled for instance to the heating roller. "Air-core transfer coupling" does not mean only complete air-core transfer coupling but it includes the cases of transfer coupling which can be considered to be substantially air-core. If necessary, however, it may also be electromagnetic coupling by an eddy current loss heating method. Moreover, the induction coils may be stationary against a rotating heating coil or may also rotate together with or separately from the heating roller. In the case of rotating, a rotary collector mechanism may intervene between a frequency-changeable high frequency power supply and the induction coils.

The plurality of induction coils are set in a relationship in which adjacent ones are in mutually reversed winding directions and the generated flux has the same polarity, that is, the same direction against the heating roller. For this reason, it is possible, by commonly connecting at least one ends of the induction coils, to eliminate or reduce a potential difference between mutually close coil ends of the adjacent induction coils. In the case of connecting a part or all of the plurality of induction coils in parallel to a common high frequency power supply, the potential difference between the coil ends on the adjacent sides of the adjacent induction coils becomes zero. Even in the case of connecting the plurality of induction coils to different high frequency power supplies, if one side, that is, stable potential sides of the high frequency power supplies are connected in common, the potential difference on the common side becomes zero and it also becomes smaller on high potential sides.

It is also possible to divide the plurality of induction coils into a plurality of groups and selectively drive them from the high frequency power supplies at a high frequency by a group. In this case, the number of the induction coils of the group located in the middle should be an even number so that the requirements of the induction coils according to the present invention will also be met between the adjacent groups. Moreover, the number of the induction coils of the group located on the end side may be either an odd number or an even number.

Furthermore, the induction coil may have a coil bobbin for supporting it. The coil bobbin may form a winding groove for supporting the induction coil in a state of regular winding. It is possible to render the coil bobbin hollow and put through an electric supply line to be connected to the induction coil therein. However, it is also possible, by directly forming or adhere the induction coil with a synthetic resin or a vitreous material instead of the coil bobbin, to constitute a plurality of the induction coils to be maintained in predetermined shape. In addition, it is also feasible to render the coil bobbin divisible along the longitudinal direction so as to accommodate the induction coil inside the coil bobbin.

Furthermore, the induction coils may be connected to individual high frequency power supplies individually or dividedly in groups. In either form, the electric supply line for feeding high frequency power to the induction coil from the high frequency power supply should be placed at a position close to an inner face or an outer face of the induction coil. When the feeder extends into the interior of the induction coils, the magnetic flux that interlinks the lead wire increases if the lead wire is near the axis of the induction coils. This produces eddy current loss in the interior of the induction coils and decreases power transmission efficiency. Such state is not desirable. In comparison, the above structure decreases the magnetic flux that interlinks the lead wire. This suppresses a relative decrease in the power transmission efficiency.

Furthermore, the plurality of induction coils may have a fixed length or different lengths. The high frequency power supplied to the induction coils is generally in proportion to application time of a high frequency voltage in the case where the high frequency power supply is common. As opposed to this, a rise in temperature of the heating roller depends on the size of the high frequency power applied to the induction coils per induction coil unit length. Therefore, in the case where the application time of the high frequency voltage is the same, the rise in temperature of a relatively long induction coil is slower than that of a relatively short induction coil. Thus, in the case where each of the plurality of long and short induction coils heats an opposed area of the heating roller at the same temperature and promptly while being switched, the application time of the high frequency voltage should be changed almost in proportion to the lengths of induction coils. It is possible to have a configuration wherein such control is performed by induction coil selection means mentioned later.

And according to the present invention, the plurality of induction coils are set in the relationship in which the adjacent ones are in mutually reversed winding directions and the generated flux has the same polarity so that, as the potential difference between the adjacent induction coils is eliminated or reduced, the insulation between the adjacent induction coils becomes easier. For this reason, it is possible to set a small distance between the adjacent induction coils. This effect is basically the same even in the case of connecting the adjacent induction coils to different high frequency power supplies. In addition, the polarity of the flux generated from the plurality of induction coils is the same, and so there is less change in the magnetic field between the adjacent induction coils. As a result of the above, proportionality of temperature distribution of the heating roller becomes good.

Furthermore, if desired, it is possible, by selectively driving the plurality of induction coils, to selectively heat a desirable area of the heating roller.

According to a first preferable embodiment of the present invention, the induction heating roller apparatus is constituted, in addition to the above configuration, to have each of the plurality of induction coils form the plurality of groups comprised of a plurality of induction coils respectively and have each of the groups connected to a different output terminal of the high frequency power supply via the independent electric supply line.

And the first embodiment provides the configuration suitable to the case of setting a plurality of heating areas to be switchable in the axial direction of the heating roller.

According to a second preferable embodiment of the present invention, the induction heating roller apparatus is constituted, in addition to the aforementioned configuration, to have the plurality of induction coils connected to the high frequency power supplies via a common electric supply line respectively.

And the second embodiment provides the configuration suitable to the case of heating the entire heating roller at the same time.

According to a third preferable embodiment of the present invention, the induction heating roller apparatus is constituted, in addition to the aforementioned configurations, to have a spacing of 2 mm or less between the adjacent induction coils. The third embodiment is the configuration as to the spacing between the adjacent induction coils at which the proportionality of temperature distribution in the axial direction of the heating roller is suitable in the case of heating the entire heating roller at the same time.

The inventors hereof discovered, to their surprise, that it is possible according to the third embodiment, by having the above configuration, to obtain power transmission efficiency of 97 to 98 percent or so to the heating roller.

According to a fourth preferable embodiment of the present invention, the induction heating roller apparatus is constituted, in addition to the aforementioned configurations, to have the electric supply lines extended in the axial direction inside the heating roller and connected to the induction coils to feed the power to the plurality of induction coils; and the coil bobbin mainly comprised of a plurality of bobbin constituting pieces divided in the axial direction and accommodating at least one of the induction coil and electric supply line therein to support the induction coil and electric supply line.

And the fourth embodiment provides another effective means for solving the problem of the electric insulation distance when the spacing between the adjacent induction coils is reduced. If the electric supply lines are accommodated in the coil bobbins, it can also provide effective means for solving the problem of the electric insulation distance between the electric supply lines and between the induction coil and electric supply line. Furthermore, it is possible, if desired, to accommodate both the induction coil and electric supply line by isolating each of them inside the coil bobbin.

According to the fourth embodiment, the induction coil and/or electric supply line are accommodated inside the coil bobbin so that the parts accommodated therein can be mechanically protected by the coil bobbin.

In addition, the induction heating roller apparatus according to the present invention has the heating roller, plurality of induction coils and high frequency power supplies, wherein the plurality of induction coils are placed in the dispersed state along the axial direction inside the heating roller with a spacing of 5 mm or less between the adjacent ones, and are set in the relationship in which the generated flux has the same polarity.

According to the present invention, it is possible to place the plurality of induction coils even closer than 5 mm, such as 2 mm or less in order to render the temperature distribution of the heating roller further even. When placing the plurality of induction coils relatively close, it is possible, if necessary for the electric insulation, to adopt known appropriate means for securing the insulation distance or characteristic configurations of the present invention aforementioned or mentioned later. For instance, as for the known appropriate means, an insulating barrier can intervene between the adjacent induction coils. In addition, as for the characteristic configuration of the present invention, it can be set in the relationship in which adjacent ones of the plurality of induction coils are in mutually reversed winding directions and the generated flux has the same polarity. And the plurality of induction coils can be individually accommodated inside the coil bobbins.

As the present invention has the above configurations, and so the proportionality of the temperature along the axial direction of the heating roller is improved. For that reason, it becomes easier, for instance, to control the toner to be within the temperature anomaly of plus or minus 15 degrees C. which is necessary to fusion-bond it evenly and securely on the paper. In short, it is possible, by using the induction heating roller apparatus according to the present invention, to cause the rise in temperature of the heated object to be heated by contacting the heating roller to be even along the axial direction of the heating roller and perform high-speed heating.

According to a fifth preferable embodiment of the present invention, the induction heating roller apparatus is constituted, in addition to the aforementioned configurations, to have the spacing of 2 mm or less between the adjacent induction coils.

And according to a sixth preferable embodiment of the present invention, the induction heating roller apparatus is constituted, in addition to the above configurations, to have auxiliary induction coils placed astride both ends of the adjacent induction coils. According to the sixth embodiment, the plurality of induction coils function as main induction coils to mainly heat the area directly facing the main induction coils of the heating roller respectively. As opposed to this, the auxiliary induction coils function, by being placed astride the adjacent main induction coils, to supplement even slight reduction in temperature formed between the adjacent main induction coils. It was verified that, if the auxiliary induction coils are placed, the power transmission efficiency from each of the induction coil to the heating roller is reduced by 30 percent or so at the maximum in the part in which it is astride the main induction coil, but the proportionality of temperature in the axial direction of the heating roller is further improved than the case of using no auxiliary induction coil.

Moreover, the auxiliary induction coil is formed to have a smaller diameter than the main induction coil so that it is wound being piled inside the main induction coil, or is inversely formed to have a larger diameter than the main induction coil so that it is wound being piled outside the main induction coil. Furthermore, the auxiliary induction coil is to supplement the main induction coil, and so it is generally formed to have a shorter axial length than the main induction coil. Moreover, the axial length by which the auxiliary induction coil lies astride the main induction coil should be as short as possible. The overlapping length between the induction coil and auxiliary induction coil should be a half or less of each induction coil. If so, the temperature distribution of the heating roller is supplemented in balance. And it keeps the axial length by which the auxiliary induction coil lies astride the main induction coil from becoming extremely large so as to hold down reduction in the power transmission efficiency.

According to a seventh preferable embodiment of the present invention, the induction heating roller apparatus is constituted, in addition to the aforementioned configurations, to have the plurality of induction coils placed in the dispersed state in the axial direction inside the heating roller and have the relationship in which the adjacent ones are in mutually reversed winding directions and the generated flux has the same polarity.

And the seventh embodiment provides effective means for, when placing the plurality of induction coils relatively close, securing the insulation distance if necessary for the electric insulation purposes. To be more specific, the potentials of the opposed coil ends of the adjacent induction coils become equal, or the potential difference is reduced. For that reason, it is possible, even if the spacing between the adjacent induction coils is set to be small enough, to eliminate an occurrence of insufficiency of the electric insulation distance. Consequently, the problem of the electric insulation distance as to the spacing between the adjacent induction coils is solved.

According to an eighth preferable embodiment of the present invention, the induction heating roller apparatus is constituted, in addition to the seventh embodiment, to have each of the plurality of induction coils form the plurality of groups comprised of a plurality of induction coils respectively and have each of the groups connected to a different output terminal of the high frequency power supply via the independent electric supply line.

And the eighth embodiment allows the plurality of induction coils to be energized by switching the groups. For that reason, it is possible to heat the heating roller by the plurality of areas divided in the axial direction.

According to a ninth preferable embodiment of the present invention, the induction heating roller apparatus is constituted, in addition to the seventh embodiment, to have the plurality of induction coils connected to the high frequency power supplies via the common electric supply line respectively.

And the ninth embodiment allows the heating roller to be heated by one operation.

According to a tenth preferable embodiment of the present invention, the induction heating roller apparatus is constituted, in addition to the above configurations, to have the electric supply lines extended in the axial direction inside the heating roller and connected to the induction coils to feed the power to the plurality of induction coils; and the coil bobbin mainly comprised of a plurality of bobbin constituting pieces divided in the axial direction and accommodating at least one of the induction coil and electric supply line therein to support the induction coil and electric supply line. The electric supply line is a conductive route for supplying the high frequency power to the induction coils placed inside the heating roller, and is extended in the axial direction inside the heating roller and also has its ends extended from the heating roller to the outside to be connected directly or indirectly to the high frequency power supply.

And the tenth embodiment can provide another effective means for, by accommodating the induction coils inside the coil bobbins, solving the problem of the electric insulation distance when the spacing between the adjacent induction coils is reduced. If the electric supply lines are accommodated in the coil bobbins, it can also provide effective means for solving the problem of the electric insulation distance between the electric supply lines and between the induction coil and electric supply line. Furthermore, it is possible, if desired, to accommodate both the induction coil and electric supply line by isolating each of them inside the coil bobbin.

According to the tenth embodiment, the induction coil and/or electric supply line are accommodated inside the coil bobbin so that the parts accommodated therein can be mechanically protected by the coil bobbin.

Furthermore, the induction heating roller apparatus according to the present invention has the heating roller, plurality of induction coils and high frequency power supplies, and is also equipped with the electric supply lines extended in the axial direction inside the heating roller and connected to the induction coils to feed the power to the plurality of induction coils; and the coil bobbin mainly comprised of the plurality of bobbin constituting pieces divided in the axial direction and accommodating at least one of the induction coil and electric supply line therein to support the induction coil and electric supply line.

According to the present invention, the electric supply line is a conductive route for supplying the high frequency power to the induction coils placed inside the heating roller, and is extended in the axial direction inside the heating roller and also has its ends extended from the heating roller to the outside to be connected directly or indirectly to the high frequency power supply. In the case where the plurality of induction coils are directly connected in parallel, a pair of electric supply lines are used. As opposed to this, in the case where the plurality of induction coils are connected in parallel via the induction coil selection means placed outside the heating roller, it is necessary to connect at least one ends of the induction coils to different electric supply lines by a unit of switching. Therefore, the induction coil requires three or more electric supply lines in this case.

The electric supply lines can be extended either inside or outside the induction coil to be led to the outside of the heating roller. However, it is desirable to have them extended in a position as close to the induction coils as possible. In the case of putting the electric supply line through the inside of the induction coil, it is not desirable to have the electric supply line close to a central axis of the induction coil because, as the flux interlinking with the electric supply lines increases, eddy current loss arises inside and the power transmission efficiency is reduced. As opposed to this, the interlinking flux is reduced by constituting them as described above so as to alleviate the reduction in the power transmission efficiency.

Furthermore, the electric supply line can branch a connecting portion for connecting to the induction coil. In addition, it is allowed to have a power terminal to be connected to the high frequency power supply side in a portion exposed to the outside from the heating roller.

The coil bobbin is used as means for supporting the induction coils and electric supply lines in a predetermined position. And it should desirably be comprised of materials superior in insulation, heat resistance and durability such as glass, ceramics and heat-resistant synthetic resin.

According to the present invention, the coil bobbin is mainly comprised of the plurality of bobbin constituting pieces divided in the axial direction of the heating roller. In a state in which the coil bobbin is completed, the bobbin constituting pieces are united by appropriate fixing means such as an adhesive or a mechanical fit. And at least one of the induction coil and electric supply line is supported by the coil bobbin in the state of being accommodated inside the coil bobbin. For this reason, members to be accommodated therein are accommodated in a state in which the bobbin constituting pieces are separated.

Furthermore, other configurations of the coil bobbin will be described.

(1) Winding groove: In the case of supporting the induction coil on the outer face of the coil bobbin, the winding groove can be formed on the outer face of the coil bobbin in order to support the induction coil in a state of the regular winding.

(2) Insulating collar: In the case of supporting the induction coil on the outer face of the coil bobbin, an insulating collar can be formed between a pair of adjacent induction coils in order to place the plurality of induction coils in the proximity and secure a required insulation distance.

And the present invention has the following effects due to the above-mentioned configurations.

1. As the induction coils and electric supply lines are supported by the coil bobbin, their positions are not undesirably moved.

2. It is possible to secure the insulation distance between the induction coils, between the electric supply lines and between the induction coil and electric supply line as required and also to place the induction coils in the proximity.

3. In conjunction with the above 2, the temperature distribution of the heating roller on heating becomes even.

4. As the coil bobbin CB is mainly comprised of the plurality of bobbin constituting pieces divided in the axial direction, it is easy to form the coil bobbin.

5. It is easy to assemble the assemblies of the coil bobbin, induction coils and electric supply lines.

6. As three or more electric supply lines can be mutually insulated to support the coil bobbin, it is possible to constitute it so as to selectively drive the plurality of induction coils.

7. In conjunction with the above 6, it is possible, by selectively driving the plurality of induction coils, to selectively heat a desired area of the heating roller.

According to an eleventh preferable embodiment of the present invention, the induction heating roller apparatus is constituted, in addition to the aforementioned configurations, to have the inside of the coil bobbin divided into a plurality of accommodation rooms isolated for the electric insulation via bulkheads placed in a dispersed state in the axial direction respectively and have the plurality of induction coils individually accommodated in each accommodation room.

According to the eleventh embodiment, the coil bobbin accommodates the induction coils inside the coil bobbin so that they will be adjacent via the bulkheads. For that purpose, a cylindrical portion and a bulkhead portion are formed in the coil bobbin. And it is constituted so that the plurality of bobbin constituting pieces vertically divided by using the fixing means are put together to complete the coil bobbin. It is desirable to divide the coil bobbin into two or three. The electric supply line can be handled as follows. (1) To adhere it to the outer face of the coil bobbin. (2) To form a groove on the outer face of the coil bobbin to accommodate it therein, fill the groove with an insulating adhesive, or block the groove with an insulating cover. (3) To form it inside the bobbin constituting piece to be united therewith in advance. In any of the above cases, it should be the configuration wherein the electric supply line and induction coil are connected by penetrating the cylindrical portion of the coil bobbin. For instance, it is possible to connect both ends of the induction coil to the electric supply line by penetrating the cylindrical portion of the coil bobbin, or branch the electric supply line and form in advance a connection line for penetrating the cylindrical portion of the coil bobbin from the electric supply line to connect to the induction coil, or connect the induction coil to the electric supply line by using a connecting conductor apart from the induction coil and electric supply line. As for the induction coil, the one formed as an air-core coil should be used. Furthermore, it is desirable to constitute the coil bobbin so that its surface is smooth with no projection and thereby reduce the distance between the induction coil and the heating roller as much as possible so as to increase a coupling factor between them.

According to a twelfth preferable embodiment of the present invention, the induction heating roller apparatus is constituted, in addition to the aforementioned configurations, to bury the electric supply lines for the plurality of induction coils inside the coil bobbin.

According to the twelfth embodiment, the coil bobbin has an electric supply line accommodation groove for accommodating the electric supply line therein formed on the bobbin constituting pieces. In addition, it has a communicating hole for communicating between the electric supply line accommodation groove and the outer face of the coil bobbin in order to accommodate the connecting portion comprised of a current-carrying element connecting the induction coils and electric supply lines. One or a plurality of the electric supply line accommodation grooves can be formed on one coil bobbin. Furthermore, the coil bobbin is constituted so that, when the coil bobbin is formed by uniting the plurality of the bobbin constituting pieces, the required insulation distance is secured among the plurality of the electric supply lines accommodated therein.

According to a thirteenth preferable embodiment of the present invention, the induction heating roller apparatus is constituted, in addition to the above configurations, to have the spacing of 2 mm or less between the adjacent induction coils.

And the thirteenth embodiment provides the configuration as to the spacing between the adjacent induction coils at which the proportionality of the temperature distribution in the axial direction of the heating roller is suitable in the case of heating the entire heating roller at the same time.

According to a fourteenth preferable embodiment of the present invention, the induction heating roller apparatus is constituted, in addition to the above configurations, to have the plurality of induction coils placed in the dispersed state in the axial direction inside the heating roller and have the relationship in which the adjacent ones are in mutually reversed winding directions and the generated flux has the same polarity.

And the fourteenth embodiment can provide effective means for, when placing the plurality of induction coils relatively close, securing the insulation distance if necessary for the electric insulation purposes. To be more specific, the potentials of the opposed coil ends of the adjacent induction coils become equal, or the potential difference is reduced. For that reason, it is possible, even if the spacing between the adjacent induction coils is set to be small enough, to eliminate an occurrence of insufficiency of the electric insulation distance. Consequently, the problem of the electric insulation distance as to the spacing between the adjacent induction coils is solved.

According to a fifteenth preferable embodiment of the present invention, the induction heating roller apparatus is constituted, in addition to the fourteenth embodiment, to have each of the plurality of induction coils form the plurality of groups comprised of a plurality of induction coils respectively and have each of the groups connected to a different output terminal of the high frequency power supply via the independent electric supply line.

And the fifteenth embodiment allows the plurality of induction coils to be energized by switching the groups. For that reason, it is possible to heat the heating roller by the plurality of areas divided in the axial direction.

According to a sixteenth preferable embodiment of the present invention, the induction heating roller apparatus is constituted, in addition to the fourteenth embodiment, to have the plurality of induction coils connected to the high frequency power supplies via the common electric supply line respectively.

And the sixteenth embodiment allows the heating roller to be heated by one operation.

As for the induction heating roller apparatus of the present invention and the preferable embodiments thereof described above, it is possible, if desired, to adopt the following embodiments as other components.

<Heating Roller>

The heating roller is magnetically coupled to the induction coils described later, and generates heat with an induction current. For this purpose, the heating roller includes a secondary coil, which forms a closed circuit circumferentially. The secondary coil is magnetically coupled, for example, air-core transformer coupled to an induction coil. In the latter case, a secondary side resistance value of the closed circuit has a value that is substantially equal to a secondary reactance of the secondary coil. The secondary side resistance and the secondary reactance being "substantially equal" refers to a range that satisfies equation 1 when the secondary side resistance is represented by Ra, the secondary reactance is represented by Xa, and $\alpha = Ra/Xa$. The reason for prescribing the mathematical requirements is disclosed in Japanese Patent Application No. 2001-016335 filed by the inventors hereof. Further, the secondary side resistance may be obtained through measurements. The secondary reactance may be obtained through calculations. Furthermore, $\alpha$ should preferably be in the range of 0.25 to 4 times, and in the range of 0.5 to 2 times at the optimum.

$$0.1<\alpha<10 \qquad \text{[Equation 1]}$$

The heating roller may include one or more than one secondary coil. When there is more than one secondary coil, it is preferred that the secondary coils be arranged in the axial direction separated from one another. A roller base made of an insulating substance may be used in order to support the secondary coils. And the secondary coils may be placed on the outer face or inner face of the roller base or inside the roller base.

Furthermore, according to the present invention, it is possible, if desired, to constitute the heating roller so as to have the heating areas of a plurality of lengths formed according to the size of the object to be heated. To be more specific, it is constituted, in the case of using the heating roller for fixing the toner image and so on, to change the heating area according to the paper size. The change of the heating area is due to collaboration with the induction coils mentioned later. The heating area will be described by taking the case of fixing the toner image as an example. For instance, in the case of fixing the toner image of A4 size paper, the necessary length of the heating area is different depending on whether the paper is fixed in portrait or landscape orientation. Also, the width of the heating area is different between the case of fixing A-4 size paper and the case of B-4 size paper. On the other hand, it is waste of the power to heat the areas other than the heating area required for the fixing, which must be avoided. On the other hand, even heating is required in the required heating area. In the case of two different heating areas, there are a common heating part for contributing to all the heating areas in common and a single heating part for contributing only to each heating area. Furthermore, as for the forms of placing the common heating part and single heating part, there are the form of putting the common heating part to either the right or left side and placing the single heating part to the other side and the form of placing the common heating part in the middle and placing the single heating parts on the right and left thereof. Either case thereof is acceptable according to the present invention.

Further, the secondary coil of the heating roller may be formed from a conductive body, such as a conductive layer, a conductive wire, or a conductive plate. To obtain the required secondary side resistance, the conductive layer may be made from the following material in the following manner. When forming the conductive layer though a thick film formation technique (application and sintering), it is preferred that the material be selected from a group consisting of Ag, Ag+Pd, Au, Pt, $RuO_2$, and C. To apply the material, a screen printing technique, a roll coater technique, or a spraying technique may be employed. In comparison, when forming the conductive layer through vapor deposition or sputtering, it is preferred that the conductive layer be made of a material selected from a group consisting of Au, Ag, Ni, and Cu+(Au, Ag). It is preferred that Cu and Al be used to form the conductive wire and the conductive plate. In the case of Cu and Al, it is desirable to form a rustproof coat on the surface in order to prevent oxidation. In the case of constituting the roller base with Fe and SUS (stainless steel), the surface coat of the roller base works as the secondary coils due to a skin effect of a high frequency. Therefore, it is not necessary to place special secondary coils as described above. Even in this case, however, it is possible to place the secondary coils apart from the roller base if required. Moreover, the roller base comprised of Fe and SUS can also have the rustproof coat such as a zinc coat formed on the surface.

To obtain a further virtual heating roller, it is preferred that the following elements be added.

1. Roller Base

A roller base, which is made of an insulative material, may be used to support the secondary coil. In this case, the secondary coil maybe arranged on the outer surface, the inner surface, or in the interior of the roller body. The insulative roller body may be formed from ceramic or glass. Taking into consideration, the heat resistant characteristic, the impact resistant characteristic, and the mechanical strength of the roller body, the following materials may be used. For example, the ceramic may be alumina, mullite, aluminum nitride, or silicon nitride. For example, the glass may be crystallized glass, quartz glass, or Pyrex®.

2. Heat Diffusion Layer

A heat diffusion layer, which is used as a means for improving the uniformity of temperature in the axial direction of the heating roller, may be arranged on the upper side of the conductive layer when necessary. Thus, it is preferred that a substance exhibiting satisfactory thermal conduction in the axial direction of the heating roller be used. Metals having high electric conductivity, such as Cu, al, Au, Ag, and Pt, often include substances having high thermal conduction. It is required that the heat diffusion layer have thermal conduction that is equal to or greater than that of the material of the conductive layer. Accordingly, the heat diffusion layer may be formed from the same material as the conductive layer.

Further, when the heat diffusion layer is formed from a conductive substance, the heat diffusion layer may conductively contact the conductive layer. However, by arranging the heat diffusion layer on an insulating film, noise would be shut out. Since a high frequency magnetic field does not reach the heat diffusion layer, a secondary current that contributes to heating is not induced in the heat diffusion layer.

3. Protection Layer

A protection layer is employed when necessary to mechanically protect and electrically insulate the heating roller or to improve the elastic contact characteristic or toner separation characteristic of the heating roller. Glass may be used as the material of a protection layer employed to mechanically protect and electrically insulate the heating roller. Synthetic resin may be used as the material of a protection layer employed to improve the elastic contact characteristic or toner separation characteristic of the heating roller. The material of the glass maybe selected from a group consisting of zinc borosilicate glass, lead borosilicate glass, borosilicate glass, and aluminosilicate glass. The material of the synthetic resin may be selected from a group consisting of silicone resin, fluororesin, polyimide resin+fluororesin, and polyamide+fluororesin. When polyimide+fluororesin or polyamide+fluororesin are employed, fluororesin is arranged on the outer side.

4. Shape of Heating Roller

A crown may be formed on the heating roller if desired. The crown may be drum-like or barrel-like.

5. Rotating Mechanism of Heating Roller

A known mechanism may be employed as the mechanism for rotating the heating roller. In the case of heat-fixing the toner image, it is possible to have the configuration wherein a pressure roller is placed to be directly facing the heating roller so that, when a record medium having the toner image formed thereon passes between the two rollers, the toner is heated and fusion-bonded to the record medium.

<High Frequency Power Supply>

The high frequency power supply generates the high frequency power and supplies it to the induction coils in order to energize the plurality of induction coils. However, the frequency (or range) of the output of the high frequency power supply is basically not restricted. For the trans scheme, it is effective to be configured to output a high frequency of 1 MHz or more, since the Q of the induction coil may be increased to increase the power transmission efficiency, using a high frequency of 1 MHz or more. When the power transmission efficiency increases, the total heating efficiency increases and power consumption is reduced. In reality, however, it is feasible to render the problem of radiation noise as easily avoidable as possible by setting it at the frequency of 15 MHz or less. The preferred frequency is 1 to 4 MHz from the viewpoint of the economy of the suitable active devices (e.g., MOSFET) and the simplicity for suppressing noise. Furthermore, the present invention may be an eddy current coupling method (eddy current heating method), and in that case, the frequency in the range of 20 to 100 kHz is suitable.

To generate a high frequency, the direct or indirect conversion of a DC or low frequency AC to a high frequency with an active device, such as a semiconductor switch device, is realistic. To obtain high frequency power from mw frequency AC, a rectifying means may be used to temporarily convert the low frequency AC to DC. The DC may be a smoothened DC formed by a smoothing circuit or a non-smoothened DC. To convert DC into a high frequency, circuit devices, such as an amplifier and an inverter, may be used. A D-grade or an E-grade amplifier, which has high power conversion efficiency, maybe used as the amplifier. A half-bridge inverter may also be used. Further, the optimal active device is a MOSFET, which has a superior high frequency characteristic. A plurality of parallel-connected high frequency power supply circuits may be configured to synthesize the high frequency output of each high frequency power supply circuit before applying the high frequency output to the induction coils. This allows the output of each high frequency power supply circuit to be small and to use the MOSFET as the active device while obtaining the required power. This inexpensively and efficiently generates the high frequency.

Furthermore, it is possible to place the high frequency power supply so as to supply the high frequency power to the plurality of induction coils in common. If necessary, however, it is also allowed to place a plurality of high frequency power supplies to the induction coils individually or in groups.

Moreover, an output frequency of the high frequency power supply may be either fixed or variable. In the case where the induction coil selection means mentioned later is comprised of switch means, it is possible to select a desired induction coil and supply the high frequency power to the induction coil irrespective of whether the output frequency is fixed or variable. As opposed to this, in the case where the induction coil selection means is comprised of filter means and a resonance circuit, it is necessary to render the output frequency of the high frequency power supply variable. To render the output frequency of the high frequency power supply variable, known frequency variable means may be used, such as rendering an oscillation frequency of an excitation circuit variable. Further, when necessary, when the apparatus is activated, the power supplied to the apparatus may be greater than that during normal operation to quickly heat the rollers.

<Other Elements>

Although the following elements are not requisite elements of the present invention, the following elements may be selected to obtain a further effective induction heating roller apparatus.

1. Induction coil selection means: The induction coil selection means is means for exerting control, by intervening between the high frequency power supply and the induction coils, to selectively supply high frequency output of the high frequency power supply to the desired induction coil, which means is effective when switching the heating areas of the heating roller. The induction coil selection means may be comprised of the filter means, resonance circuit or switch means for instance. If there are one or more induction coils to constantly have the high frequency power supplied, of the plurality of induction coils, it is not necessary to have the induction coil selection means intervening between the induction coils and the high frequency power supply. However, it should have the configuration wherein the remaining induction coils have supply of the high frequency power controlled by the intervening induction coil selection means.

In addition, it is possible, by using the induction coil selection means, to change the application time of the high frequency power to the induction coils. It thereby becomes possible to render the high frequency power supplied to the first and second induction coils per unit length the same and also change the applied power per unit length. To control the application time of the high frequency power, PWM control may be performed, for instance, in addition to change of the frequency. It thereby becomes possible, even in the case of seemingly the same application time, to render real application time for actually applying the high frequency power different therefrom. The PWM control may be performed in each half cycle or at a relatively low frequency such as 1 to 100 Hz.

Hereafter, configuration examples of the induction coil selection means will be described.

(1) Configuration with the Filter Means

The filter means intervenes between the high frequency power supply in a frequency variable form and the induction coils. And the frequency of a high frequency wave applied to the filter means is changed so as to selectively supply the high frequency power mainly to, of the plurality of induction coils, the desired one or plurality of induction coils.

(2) Configuration with the Resonance Circuit

The resonance circuit is constituted with the induction coil as a resonance circuit element. As the induction coil mainly includes an inductance, it can generally constitute the resonance circuit by adding a capacitor. The resonance circuit may be either a series resonance circuit or a parallel resonance circuit to the high frequency power supply in the frequency variable form. The former connects the series connection circuit of the induction coil and capacitor to the high frequency power supply in the frequency variable form. The latter connects the parallel circuit of the induction coil and capacitor to the high frequency power supply in the frequency variable form. If necessary, however, the inductance may be added in addition to the induction coil. And in the case of constituting a plurality of resonance circuits including the first and second induction coils as resonance circuit components, there should be at least two different kinds of resonance frequencies thereof.

Furthermore, if necessary, it is possible to constitute it to have at least two different values as to the size of Q which is selectivity together with the resonance frequencies among the plurality of resonance circuits.

(3) Configuration with the Switch Means

The switch means may be either in a contact form or in a no contact form. The switch means is generally connected in series to the induction coil. If necessary, however, it may be constituted, by making a parallel connection and shorting the induction coil, to block the supply of the high frequency power to the induction coil. Moreover, the latter connection form allows a plurality of induction coils to be serially connected to the high frequency power supply.

2. Warm-Up Control

When the operation of the apparatus is started, or when the apparatus is being warmed up after the supply of power starts, the heating roller is controlled so that it rotates at a speed lower than during normal operation.

3. Temperature Control of Hating Roller

To maintain the temperature of the heating roller within a predetermined range at a constant value, for example 200° C., the surface of the heating roller is in contact with a heat sensitive device in a thermally conductive manner. A thermistor having a negative temperature characteristic or a non-linear resistor having a positive temperature characteristic may be used as the heat sensitive device.

4. Transfer Sheet

When using the heating roller to heat a heated object, the heating roller may be directly pressed against the heated object. However, if necessary, a transfer sheet may be arranged between the heating roller and the heated object. In this case, the transfer sheet may be endless or roll-like. By using the transfer sheet, the heating and transferring of the heated object are performed smoothly.

The image formation apparatus according to the present invention is characterized by having an image formation apparatus proper having image formation means for forming the toner image on the record medium, and the fixing apparatus placed on the formation apparatus proper for fixing the toner image on the record medium, having a fixing apparatus proper with the pressure roller and the induction heating roller apparatus according to claim 1 placed to fix the toner image with the heating roller placed to be facing the pressure roller of the fixing apparatus proper in a pressure welding relationship while carrying the record medium having the toner image formed thereon sandwiched between the rollers.

In the present invention, the image formation unit forms an image that forms image information on the recording medium through an indirect technique or a direct technique. The term "indirect technique" refers to a technique for forming an image through transcription. The image formation apparatus corresponds to, for example, an electronic photograph copying machine, a printer, or a facsimile.

The recording medium corresponds to, for example, a transcription material sheet, a printing paper, an electronic facsimile sheet, or an electrostatic recording sheet.

A further perspective of the present invention is a fixing apparatus including a pressing roller, and an induction heating roller apparatus including a heating roller pressed by the pressing roller. The induction heating roller apparatus holds a recording medium, on which a toner image is formed, between the pressing roller and the heating roller to transfer the recording medium and fix the toner image on the recording medium. The induction heating roller includes a plurality of induction coils arranged separately along an axial direction of the heating roller. The heating roller includes a secondary coil that is air-core transfer coupled to the induction coils. The induction heating roller further includes a plurality of capacitors, each being connected to one of the induction coils to form a resonance circuit. At least one of the resonance circuits has a resonance point that differs from the remaining resonance circuits. A pressing roller and a heating roller may be directly pressed against each other. However, if necessary, a transfer sheet may be arranged in between the pressing roller and the hating roller so that they are indirectly pressed against each other. The transfer sheet may be endless or roll-like. A toner image is fixed at a high speed while a recording medium, on which the toner image is formed, is transferred in a state held between the pressing roller and the heating roller.

And according to the present invention, it is possible to implement the image formation apparatus with good proportionality of the temperature in the axial direction of the heating roller and suited to a high-speed type.

Figure 1:
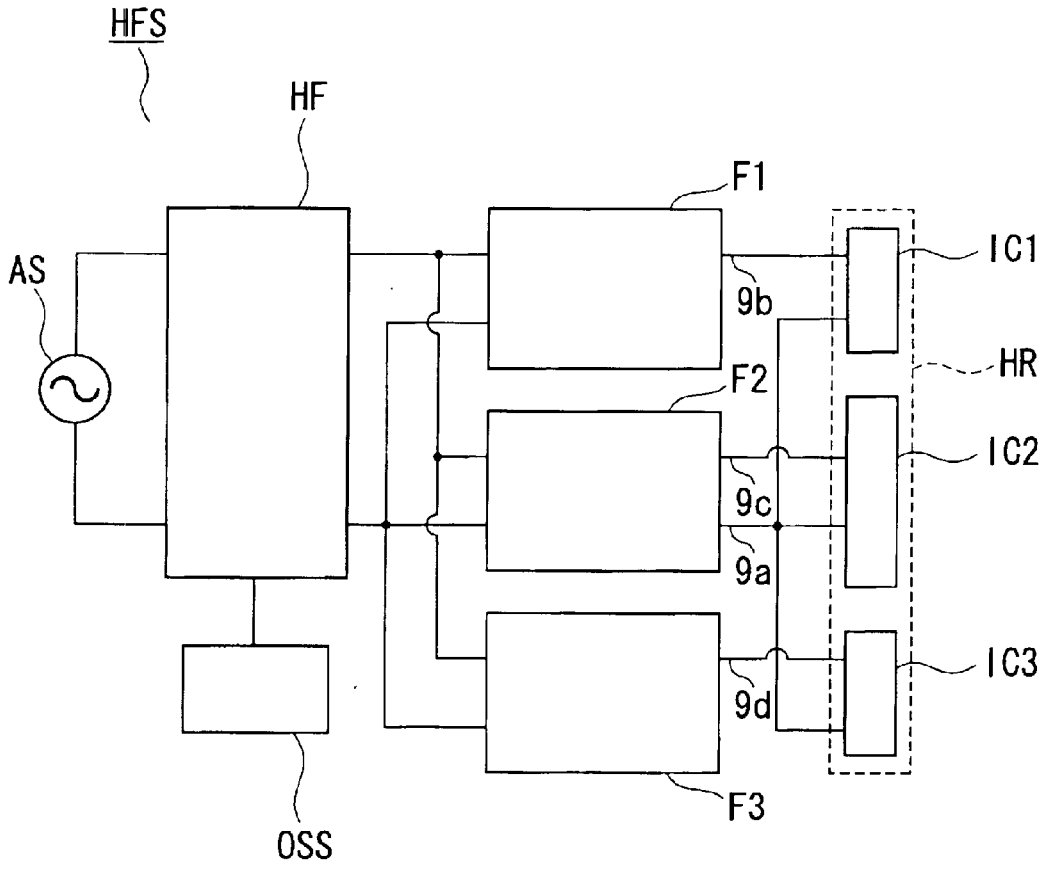
FIG. 1 is a schematic circuit block diagram showing an induction heating roller apparatus according to a first embodiment of the present invention.
Figure 2:
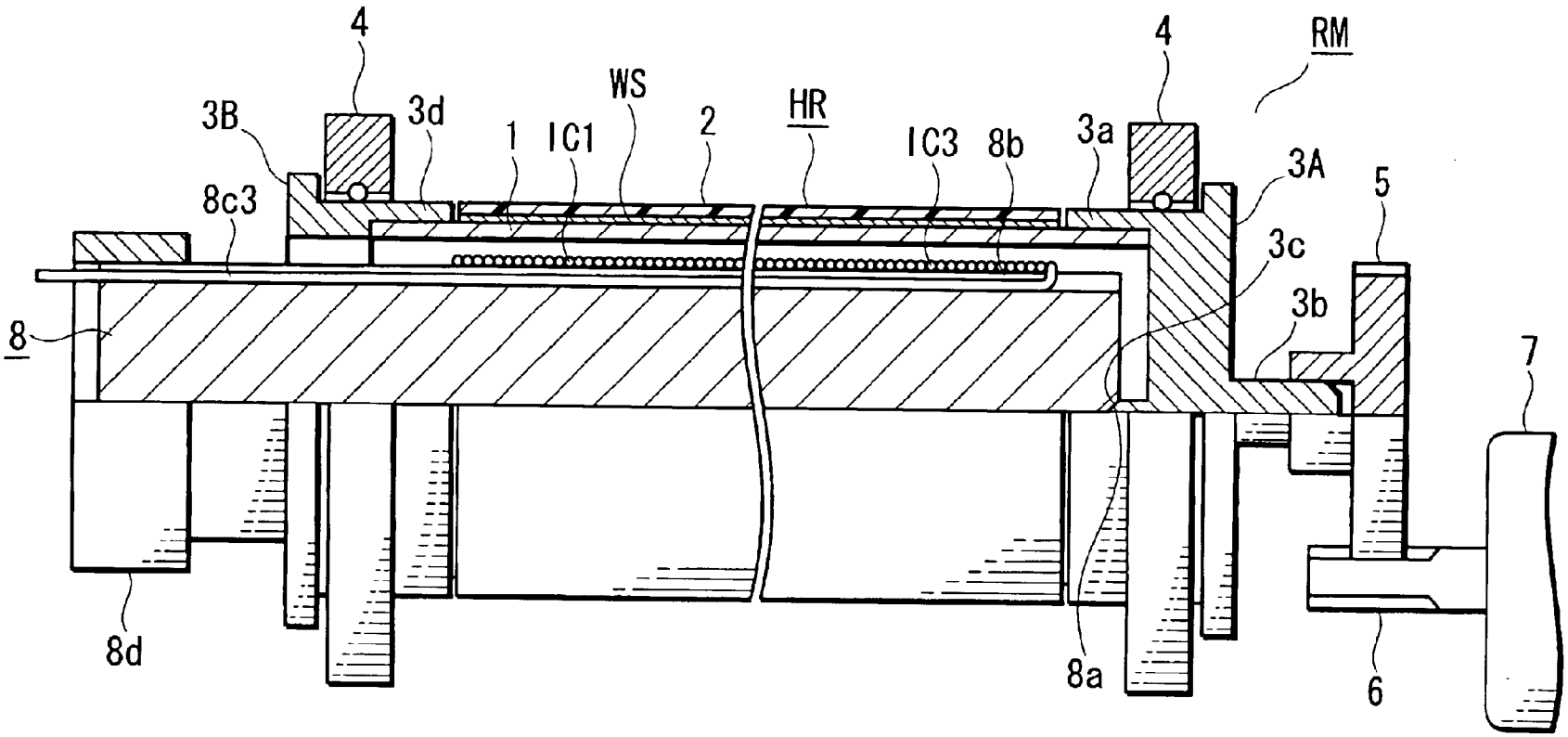
FIG. 2 is a partially cutaway front cross-sectional view of an induction coil and a heating roller.

The first embodiment of the induction heating roller apparatus according to the present invention will be described by referring to FIGS. 1 to 6. The induction heating roller apparatus according to this embodiment is comprised of a heating roller HR, induction coils IC, a high frequency power supply HFS and induction coil selection means F1, F2 and F3. In addition, as shown in FIG. 2, the heating roller HR has a rolling mechanism RM and is driven and rotated by it. Hereafter, the configuration of each of the components will be described in detail.

<Heating Roller HR>

The heating roller HR, which is driven by the rotating mechanism RM, includes a roller base 1, a secondary coil ws, and a protection layer 2. The roller base 1, which is a hollow cylindrical body and made of alumina ceramic, has, for example, a length of 300 mm and a thickness of 3 mm. The secondary coil ws is a Cu vapor deposition film, which is formed from a film-like cylindrical single-turn coil, and arranged along the entire effective length in the axial direction on the outer surface of the roller base 1. The thickness of the secondary coil ws is set so that a secondary side resistance in the circumferential direction of the heating roller HR is 1Ω, the value of which is substantially the same as that of a secondary reactance. The protection layer 2 is made at fluororesin and formed by coating the outer surface of the secondary coil ws.

The rotating mechanism RM is a mechanism for rotating the heating roller HR. As shown in FIG. 2, the rotating mechanism RM includes a first end member 3A, a second end member 3B, two bearings 4, a bevel gear 5, a spline gear 6, and a motor 7. The first end member 3A includes a cap 3*a*, a drive shaft 3*b*, and an inner end 3*c*. The left end of the cap 3*a*, as viewed in FIG. 2, is fitted on the heating roller HR and fixed to the heating roller HR by a bolt (not shown). The drive shaft 3*b* extends outward from the outer central portion of the cap 3*a*. The inner end 3*c* extends inward from the inner central portion of the cap 3*a*. The second end member 3B includes a ring 3*d*. The right end of the ring is fitted on the heating roller HR by a bolt (not shown). One of the two bearings 4 rotatably supports the outer surface of the cap 3*a* of the first end member 3A. The other one of the two bearings 4 rotatably supports the outer surface of the second end member 3B. Accordingly, the heating roller HR is rotatably supported by the first and second end members 3A, 3B, which are connected to the ends of the heating roller HR, and the pair of bearings 4. The bevel gear 5 is attached to the drive shaft 3*b* of the first end member 3A. The spline gear 6 is meshed with the bevel gear 5. The motor 7 has a rotor shaft, which is directly connected to the spline gear 6.

<Induction Coils IC>

Figure 4:
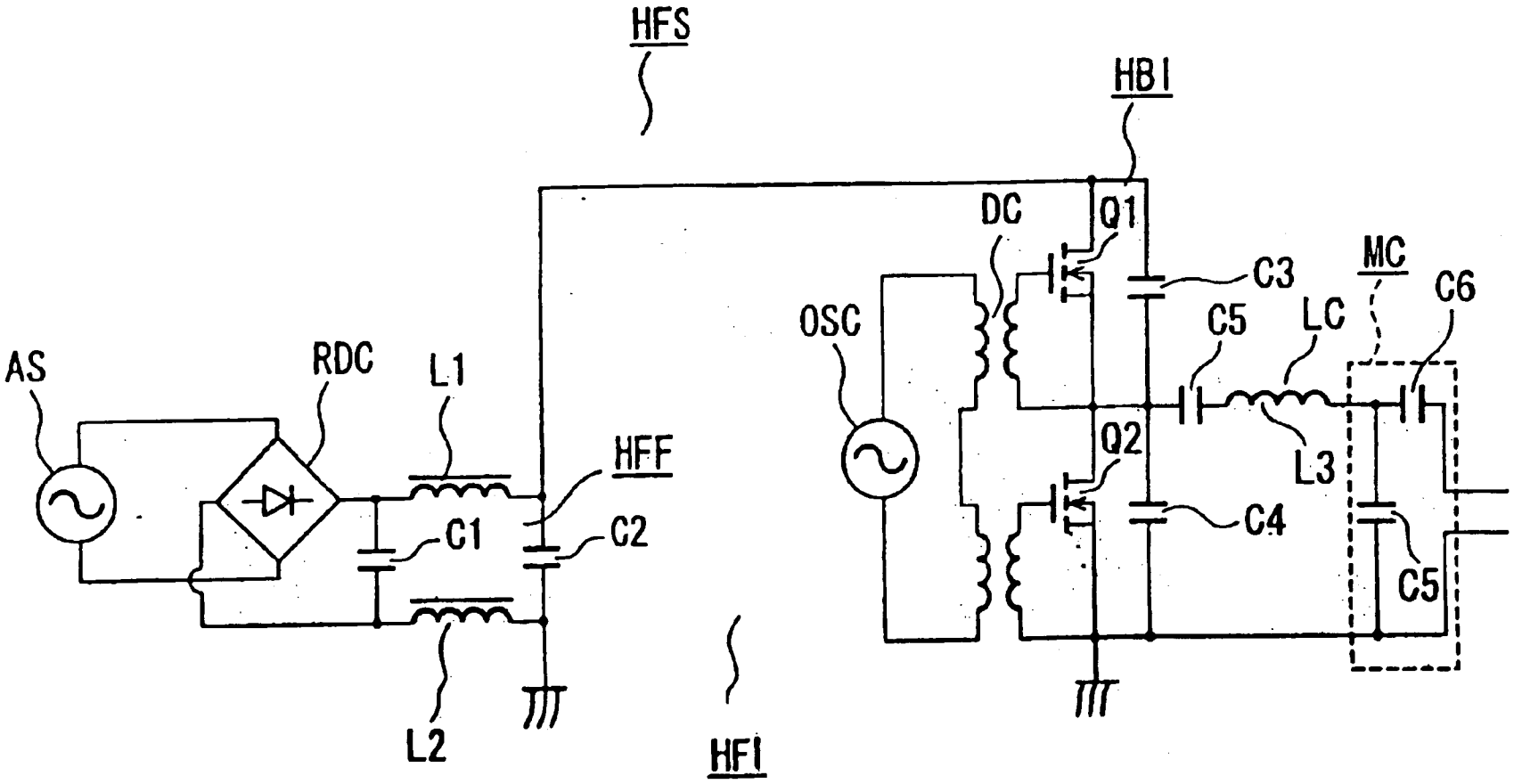
FIG. 4 is a circuit diagram of an electric circuit.
Figure 5:
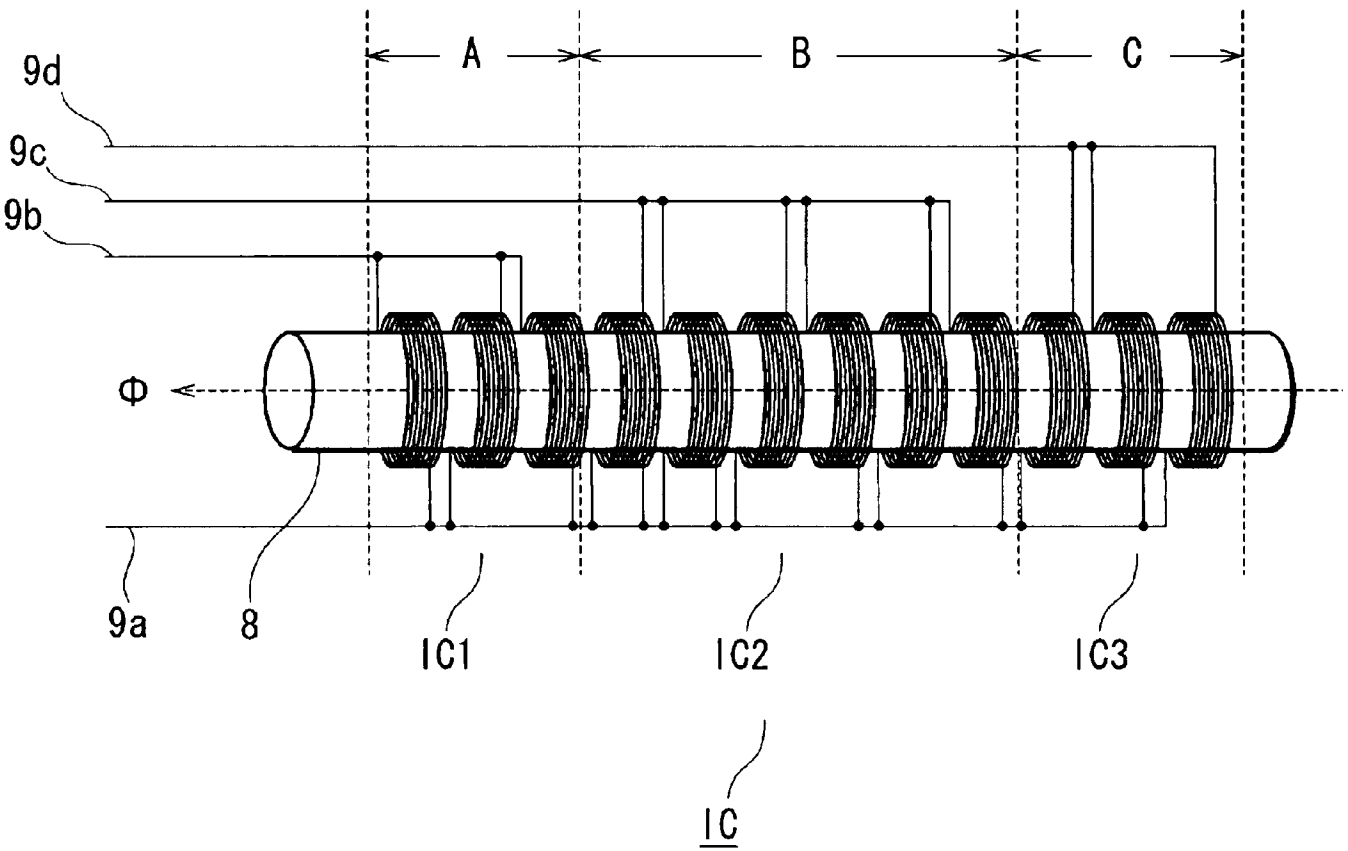
FIG. 5 is a conceptual diagram showing a connection form of a plurality of induction coils and a polarity of generated flux.
Figure 6:
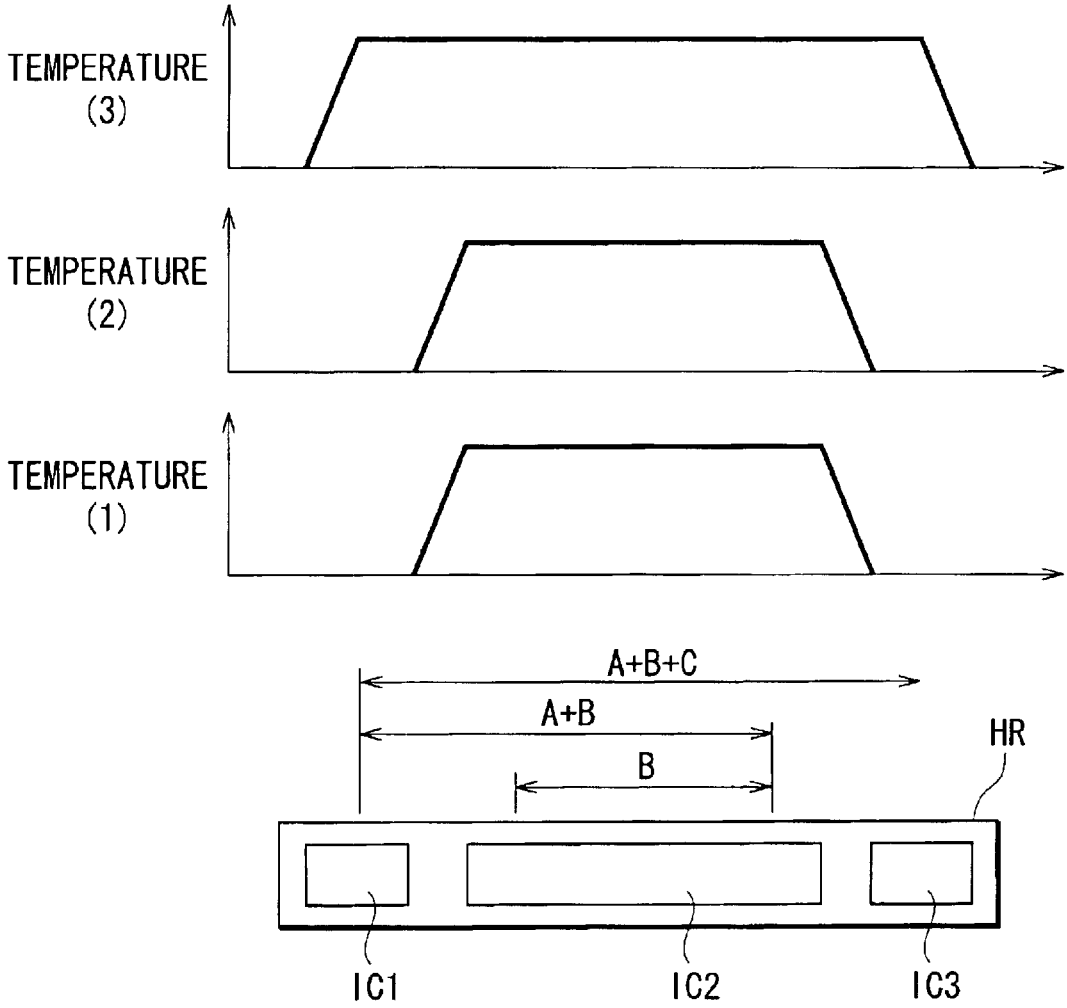
FIG. 6 is a conceptual diagram for explaining a relationship between switching of the induction coils and temperature distribution of the heating roller.

As shown in FIG. 5, a plurality of the induction coils IC are adjacently placed with a small mutual spacing, and are divided into first, second and third induction coil groups IC1, IC2 and IC3 to be wound around a coil bobbin 8. In FIGS. 1, 4 and 6, the first, second and third induction coil groups IC1, IC2 and IC3 are represented as if they are a single coil in order to simplify the drawings.

The first induction coil group IC1 is comprised of three induction coils adjacently placed along the axial direction of the heating roller HR. The second induction coil group IC2 is comprised likewise of six induction coils adjacently placed sequentially. The third induction coil group IC3 is comprised likewise of three induction coils adjacently placed. And the induction coils IC are in the relationship in which the adjacent ones are in mutually reversed winding directions as to all of the first, second and third induction coil groups IC1, IC2 and IC3. In addition, as shown in FIG. 5, flux Φ generated from the plurality of induction coils is associated with a polarity to be in the same direction to an axis of the heating roller HR.

As shown in FIG. 1, the first induction coil group IC1 is placed in a position facing a heating area A adjacent to the heating roller HR. Likewise, the second induction coil group IC2 is placed in a position facing a heating area B, and the third induction coil group IC3 is placed in a position facing a heating area C respectively. And the induction coil groups IC1, IC2 and IC3 are magnetically coupled to a secondary coil ws of the heating roller HR. The first, second and third induction coil groups IC1, IC2 and IC3 have their placement positions fixed by being wound around the coil bobbin 8.

Furthermore, as shown in FIG. 5, the plurality of induction coils of the first, second and third induction coil groups IC1, IC2 and IC3 have one ends thereof extended downward in the drawing connected in common to an electric supply line 9*a* of a stable potential at the bottom of the drawing. As opposed to this, the other ends of the plurality of induction coils extended upward in the drawing are connected, by each of the induction coil groups, to electric supply lines 9*b*, 9*c* and 9*d* on a unique high potential side at the top of the drawing.

On the other hand, the coil bobbin 8, as shown in FIG. 2, which is a solid cylindrical body made of fluororesin, has a recess 8*a*, a support portion 8*b*, and grooves 8*c*0, 8*c*1, 8*c*2 and 8*c*3. The recess 8*a* is formed in the center of the distal end of the coil bobbin 8 and is engaged with the rotating mechanism RM in a relatively rotatable manner. The support portion 8*b* is formed on the basal end of the coil bobbin 8 and fixed to a fastening portion (not shown). The grooves 8*c*0, 8*c*1, 8*c*2 and 8*c*3 are formed dispersedly in a cask-like manner on the peripheral surface of the coil bobbin 8 at intervals of 90° to connect the feeders 9*a*, 9*b*, 9*c* and 9*d*. The feeders 9*a*, 9*b*, 9*c*, 9*d* are extended out of the basal end of the coil bobbin 8, and connected to induction coil selection means F1, F2 and F3 described below.

The first, second and third induction coils IC1, IC2 and IC3 are used in a stationary state. The three induction coils IC1, IC2 and IC3 are inserted in the heating roller HR from the ring 3*d* of the second end member 3B of the heating roller HR. The recess 1*a* formed in the distal end of the coil bobbin 8 is engaged with the inner end 3*c* of the first end member 3A. The support portion 8*b*, which is formed in the basal end, is fixed to the fastening portion. Accordingly, the three induction coils IC1, IC2, IC3 are supported coaxially with the heating roller HR and maintained in a stationary state even if the heating roller HR is rotated.

<High Frequency Power Supply HFS>

As shown in FIG. 4, the high frequency power supply HFS is comprised of a low frequency power supply AS, a direct current power supply RDC, a high frequency generating portion HFI and a matching circuit MC. In FIG. 1, a reference symbol HF denotes an aggregation of the direct current power supply RDC, high frequency generating portion HFI and matching circuit MC thereof.

The low frequency AC power source is formed by, for example, a 100V commercial AC power source.

The DC power source DC is a rectifying circuit and has an input terminal, which is connected to the low frequency SC power source AS. The DC power source DC coverts the low frequency AC voltage to a non-smoothened DC voltage, which is output from the DC output terminal of the DC power source DC.

The high frequency generating portion HFI is comprised of a high frequency filter HFF, a high frequency oscillator in a frequency variable form OSC, a drive circuit DC, a half-bridge inverter main circuit HBI, a load circuit LC, and an external signal source OSS (shown in FIG. 1). The high frequency filter HFF is comprised of a pair of inductors L1, L2 serial to both the lines and a pair of capacitors C1, C2 connected between the lines before and after the pair of inductors L1, L2, and intervenes between the DC power supply RDC and the half-bridge inverter main circuit HBI described later so as to keep the high frequency from flowing out to the low frequency AC power supply AS side. The high frequency oscillator OSC varies the oscillation frequency and is controlled by an external signal source OSS described below to generate a high frequency signal with variable frequency and sends the high frequency signal to the drive circuit DC. The drive circuit DC, which is a preamplifier, amplifies the high frequency signal sent from the high frequency oscillator OSC to output the drive signal. The half-bridge inverter main circuit HBI includes two MOSFETs Q1, Q2, which are connected in series between the output terminals of the DC power supply RDC, and two capacitors C3, C4, which are connected parallel to the MOSFETs Q1, Q2. The MOSFETs Q1, Q2 are alternately switched by drive signals of a drive circuit DC. The half-main bridge inverter main circuit HBI converts the DC output of the DC power supply RDC to a high frequency having a substantially rectangular wave. The capacitors C3, C4 function as a high frequency bypass when inverting is being performed. The load circuit LC includes a DC cut capacitor C5, an inductor L3 and a matching circuit MC described below. The DC Cut capacitor C5 prevents a DC component from flowing to the load circuit LC from the DC power supply DC side via the MOSFETs Q1, Q2. The inductor L3 and the matching circuit MC form a series resonance circuit and waveform shape the high frequency voltage applied to the three induction coils IC1, IC2, IC3. The waveform shaped high frequency voltage biases the three induction coils IC1, IC2, IC3. The external signal source OSS varies the output frequency of the high frequency power supply HFS and controls the oscillator OSC to vary the oscillation frequency of the oscillator OSC according to the heating range selected by operation.

The matching circuit MC is an impedance conversion circuit comprised of a capacitor C6 serial to a high frequency output line and a capacitor C5 parallel therewith, and is placed close to the high frequency generating portion HFI. And it matches impedances of loads seen from the high frequency generating portion HFI and matching circuit MC so as to increase the power transmission efficiency.

<Induction Coil Selection Means F1, F2 and F3>

The induction coil selection means F1, F2 and F3 are comprised of band-pass filters of which pass bands are mutually different. As for their respective pass bands, for instance, the induction coil selection means F1 is 1 MHz, the induction coil selection means F2 is 2 MHz, and the induction coil selection means F3 is 3 MHz. And the induction coil selection means F1 serially intervenes between the high frequency power supply HFS and the first induction coil group IC1. The induction coil selection means F2 is connected likewise to the second induction coil group IC2. In addition, the induction coil selection means F3 is connected likewise to the third induction coil group IC3.

<Operation of the Induction Heating Roller Apparatus>

The low frequency AC voltage of the low frequency AC power supply AS is converted into a DC voltage by the DC power supply RDC, is further converted into a high frequency voltage by the high frequency power supply HFS, and is further applied selectively to the first to third induction coil groups IC1, IC2 and IC3 in a standing-still state by way of the induction coil selection means F1, F2 and F3.

If the external signal source OSS is operated to cyclically switch the frequency of the high frequency output of the high frequency power supply HFS to 1 MHz and 2 MHz alternately at a low frequency of 10 Hz for instance, the induction coil selection means F1 passes 1 Mhz so that, when the high frequency power supply HFS is outputting 1 MHz, the first induction coil group IC1 is energized in a time-shared manner. In addition, when the high frequency power supply HFS is outputting 2 MHz, the second induction coil group IC2 is energized in a time-shared manner. For that reason, the first induction coil group IC1 and the second induction coil group IC2 are air-core-transfer-coupled to the secondary coil ws of the heating areas A and B of the heating roller HR facing them, so that a secondary current is induced to the secondary coil ws in a go-around direction of the heating roller HR. Consequently, a resistance R of the secondary coil ws generates Joule heat. As a result, the heating areas A and B are evenly heated as shown in FIG. 6 (2).

As opposed to this, if the external signal source OSS is operated to cyclically switch the frequency of the high frequency output of the high frequency power supply HFS to 1 MHz, 2 MHz and 3 MHz alternately at a low frequency of 10 Hz for instance, the induction coil selection means F1, F2 and F3 pass the high frequency powers of their respective pass frequencies so that the first, second and third induction coil groups IC1, IC2 and IC3 are mutually switched in a time-shared manner to be energized. As a result, it works as in the above description, and the heating areas A, B and C of the heating roller HR are evenly heated as shown in FIG. 6 (3).

As opposed to this, if the external signal source OSS is operated to switch the frequency of the high frequency output of the high frequency power supply HFS to 2 MHz for instance, only the induction coil selection means F2 passes the high frequency power so that only the second induction coil group IC2 is energized. As a result, it works as in the above description, and the heating area B of the heating roller HR is evenly heated as shown in FIG. 6 (1).

Figure 3:
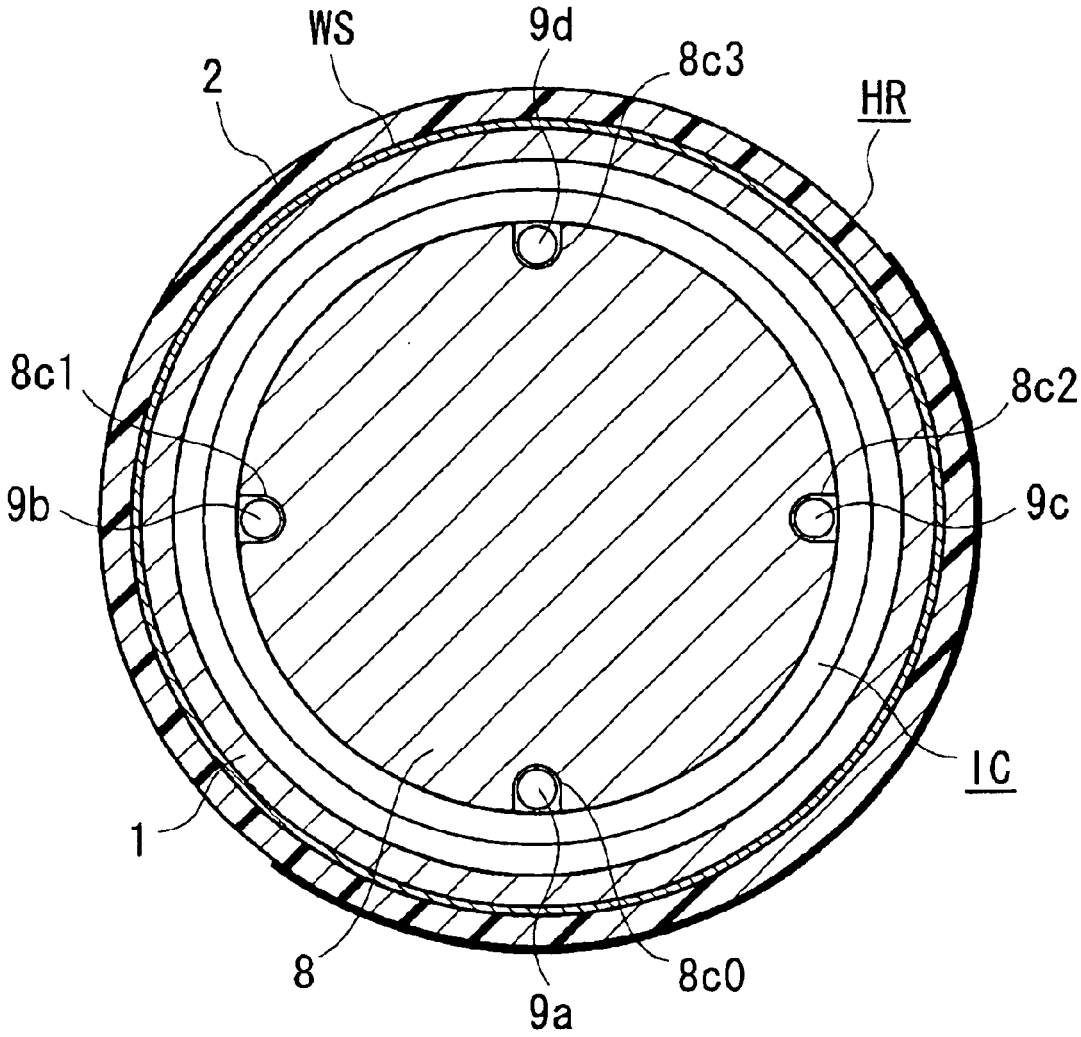
FIG. 3 is a side cross-sectional view of the induction coil and the heating roller.

Hereafter, other embodiments of the induction heating roller apparatus according to the present invention will be described by referring to FIGS. 7 and 3. In the drawings, the same portions as in FIGS. 1 and 5 are given the same symbols, and description thereof will be omitted.

Figure 7:
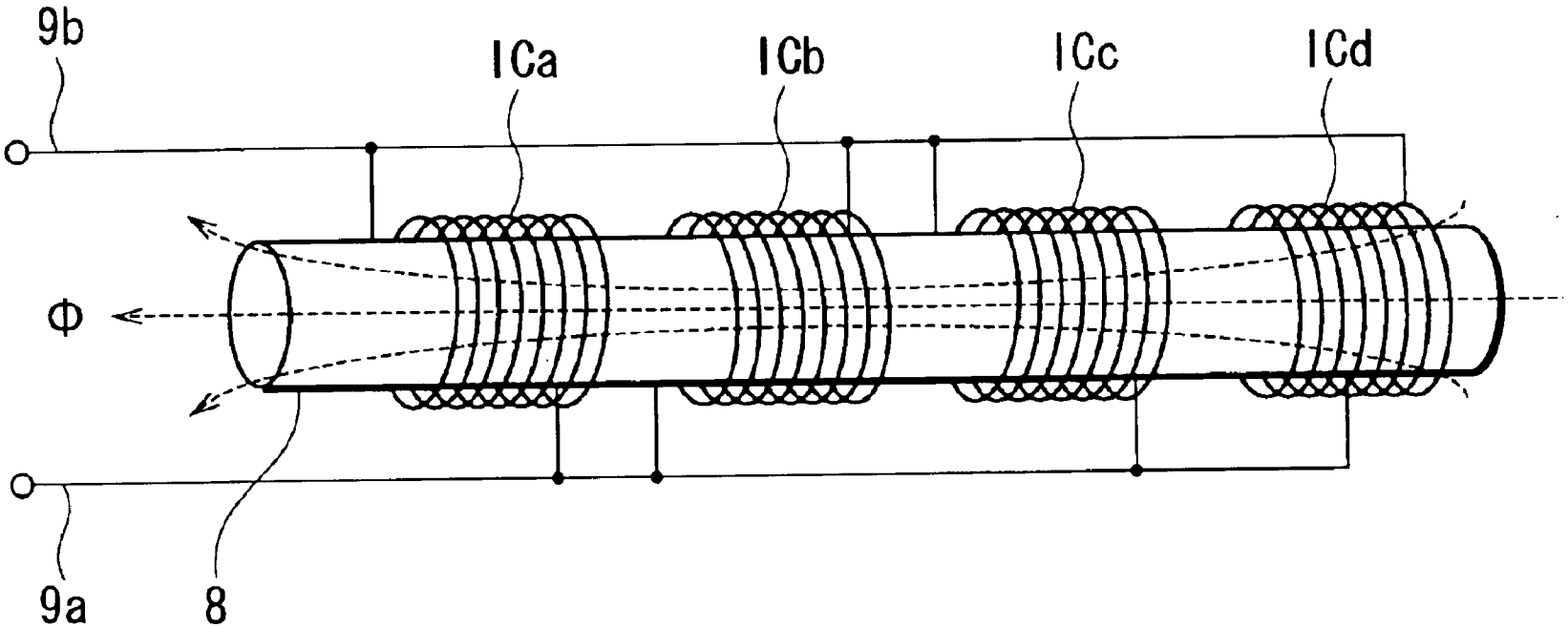
FIG. 7 is a conceptual diagram showing the connection form of the plurality of induction coils and the polarity of the generated flux according to a second embodiment of the induction heating roller apparatus according to the present invention.

As shown in FIG. 7, the second embodiment is comprised of four induction coils ICa, ICb, ICc and ICd of which induction coils IC are of the same specifications (coil length, coil pitch and coil diameter), and they are fixedly connected in parallel between a pair of common electric supply lines 9*a* and 9*b*.

Figure 8:
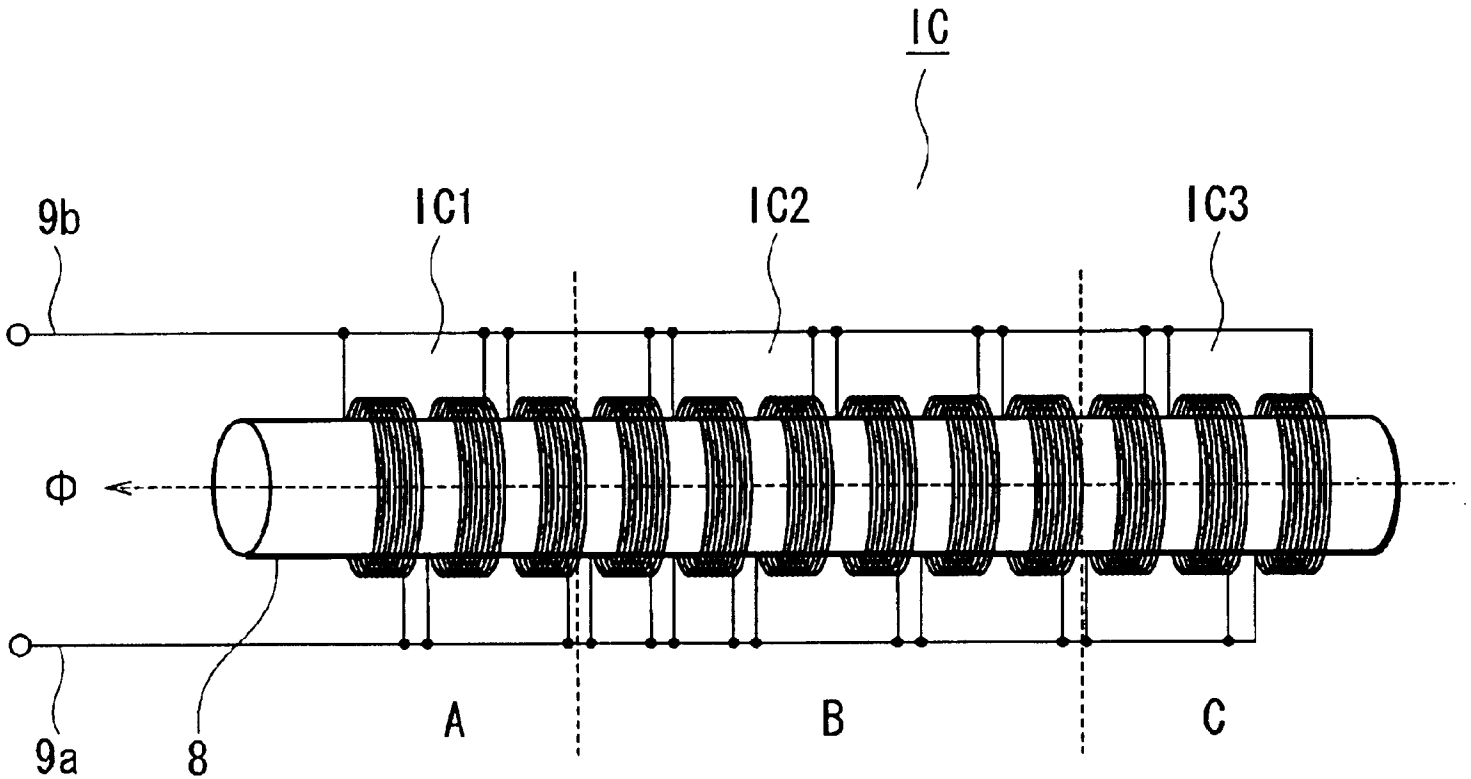
FIG. 8 is a conceptual diagram showing the connection form of a plurality of induction coils and the polarity of the generated flux according to a third embodiment of the induction heating roller apparatus according to the present invention.

As shown in FIG. 8, the third embodiment has the same number of the induction coils IC as the first embodiment shown in FIG. 5, and they are fixedly connected in parallel between the pair of common electric supply lines 9*a* and 9*b*.

Figure 9:
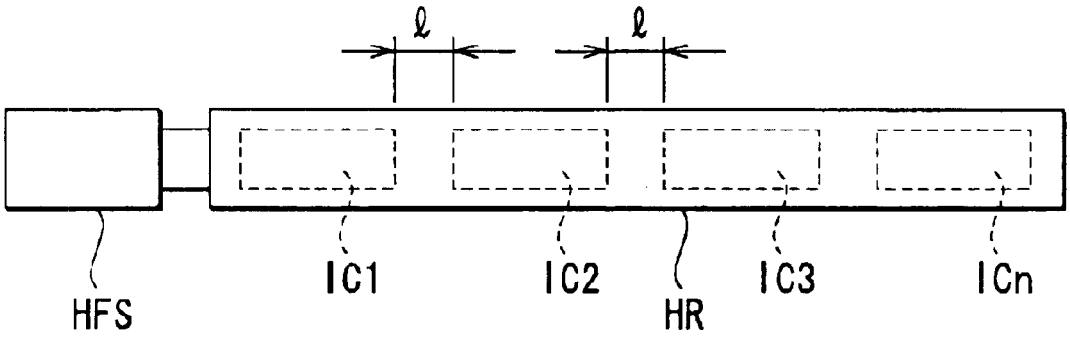
FIG. 9 is a conceptual diagram showing the heating roller, induction coils and high frequency power supplies according to a fourth embodiment of the induction heating roller apparatus according to the present invention.

As shown in FIG. 9, the fourth embodiment has a plurality of coils IC1 to ICn closely placed with a spacing 1 of 5 mm or less along the axial direction inside the heating roller HR. The heating roller HR has the same configuration as shown in FIGS. 2 and 3.

Figure 10A:
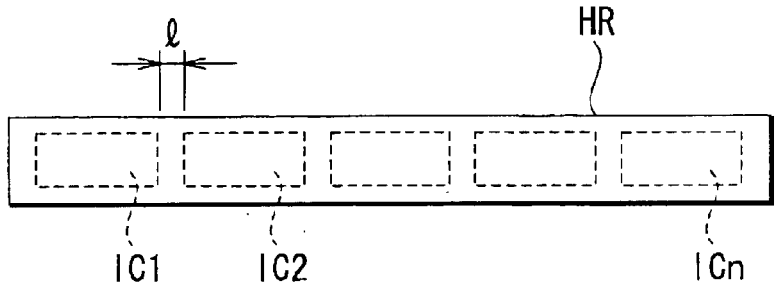
FIG. 10 is a graph showing a layout of the plurality of induction coils and the heating roller and the temperature distribution of the heating roller.
Figure 10B:
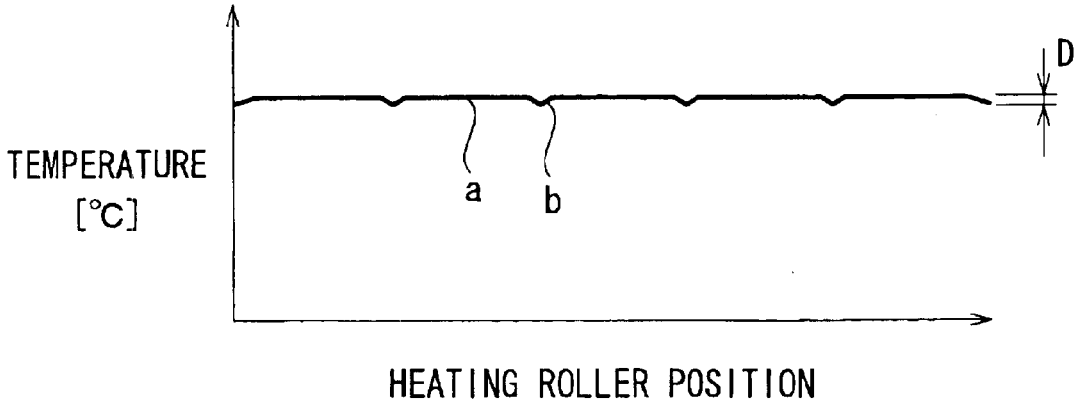

According to the fourth embodiment, as shown in FIG. 10B, the proportionality of temperature distribution of the heating roller HR becomes good. To be more specific, the area directly facing the induction coils IC1 to ICn can have even temperature distribution as indicated by a symbol a in the drawing, and the area directly facing the spacing among the induction coils IC1 to ICn has the temperature remaining a little lower as indicated by a symbol b so that it was possible to keep their temperature difference D within plus or minus 15 degrees C. while maintaining the power transmission efficiency of 95 percent or more. It is possible, if within the temperature difference D, to hold down temperature variations of the heating roller HR within a set value so as to improve the proportionality of temperature distribution. If the power transmission efficiency is 90 percent or more, it can generally bear practical use.

Figure 11:
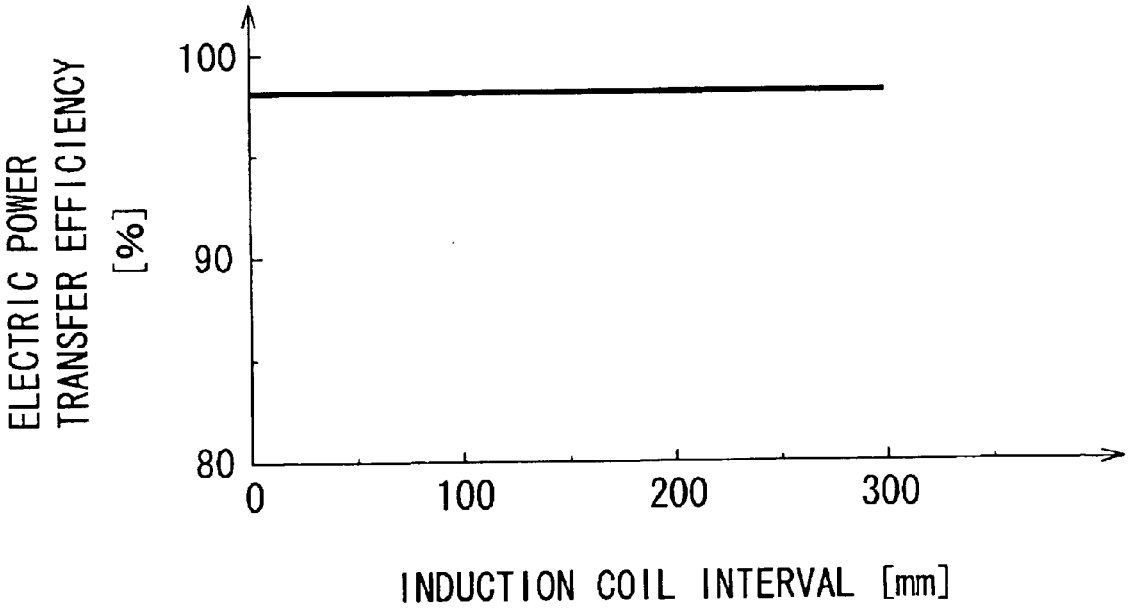
FIG. 11 is a graph showing a relationship between spacing among the plurality of induction coils and the power transmission efficiency to the heating roller.

Next, as a result of investigating the transmission efficiency by changing the spacing 1 mutually among the induction coils IC1 to IC3, characteristic data as shown in FIG. 11 was obtained by measuring the change of the transmission efficiency by changing the spacing 1 among the induction coils IC1 to IC3. As is apparent from this characteristic diagram, it turned out that the transmission efficiency is almost fixed without being influenced by the size of the spacing 1 among the induction coils IC1 to IC3. This consequently knocked the bottom out of the idea that, as presumed so far that, if the plurality of induction coils IC1 to IC3 are closely placed in order to improve the proportionality of temperature distribution of the heating roller HR, formation flux generated by the induction coils IC1 to IC3 interlink mutually among the adjacent induction coils IC1 to IC3 to generate inductive loss, leading to deterioration of the power transmission efficiency on transmitting the power from the induction coils IC1 to IC3 to the heating roller HR, and thus the induction coils IC1 to IC3 should be placed by sufficiently taking the spacing 1 without placing them close to one another.

Figure 12:
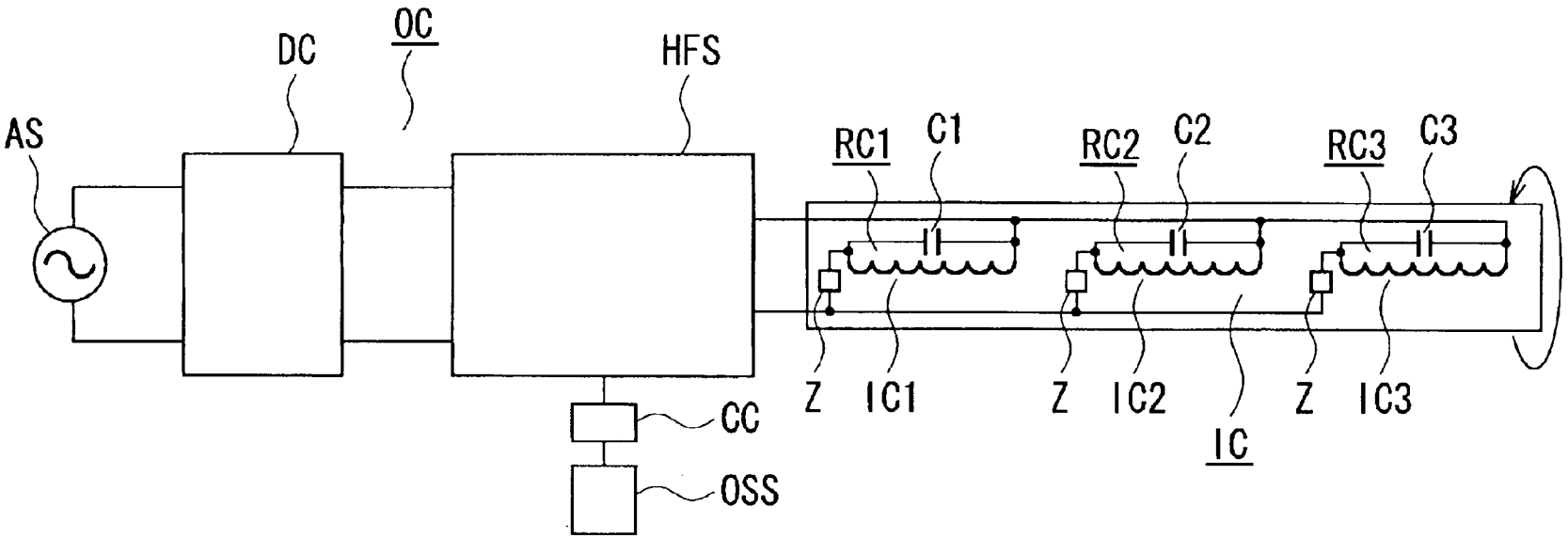
FIG. 12 is a circuit block diagram showing a circuit configuration of the high frequency power supply and induction coils according to a fifth embodiment of the induction heating roller apparatus according to the present invention.

As shown in FIG. 12, according to the fifth embodiment of the induction heating roller apparatus of the present invention, the plurality of induction coils IC1 to IC3 placed in the heating roller HR are connected in parallel to the capacitors C1, C2 and C3 to constitute parallel resonance circuits RC1, RC2 and RC3 respectively. The resonance circuits RC1, RC2 and RC3 are connected mutually in parallel to the high frequency power supply HFS. The high frequency power supply HFS has its input terminal connected to a direct-current power supply DC for rectifying an AC voltage from the low frequency AD power supply AS, and is equipped with the external signal source OSS and control means CC. The resonance circuits RC1, RC2 and RC3 have different resonance frequencies respectively, and have the function equivalent to the induction coil selection means F1, F2 and F3 in FIG. 1. To be more specific, it is possible, by changing the oscillation frequency of the high frequency power supply HFS by way of the external signal source OSS and control means CC, to selectively resonate the resonance circuits RC1, RC2 and RC3 so as to selectively energize a desired one of the induction coils IC1 to IC3. Consequently, it is possible to heat only the area directly facing the energized induction coil of the heating roller HR.

Figure 13:
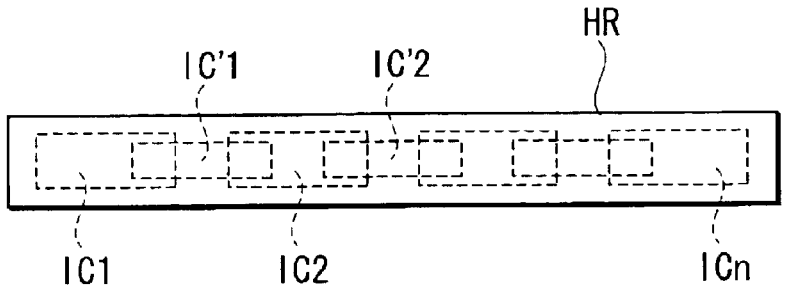
FIG. 13 is a graph showing a layout of the plurality of induction coils, auxiliary induction coils and heating roller and the temperature distribution of the heating roller according to a sixth embodiment of the induction heating roller apparatus according to the present invention.
Figure 13:
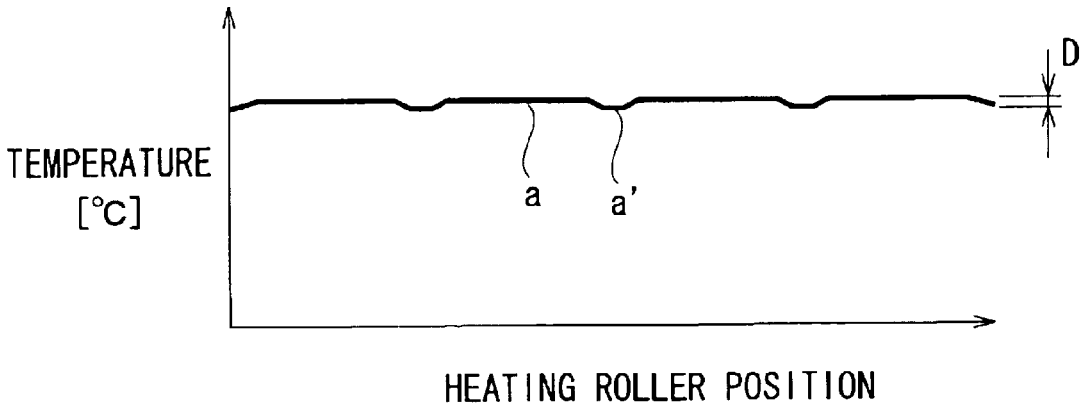

As shown in FIG. 13, the sixth embodiment of the induction heating roller apparatus according to the present invention has the main induction coils IC1 to ICn and auxiliary induction coils IC'1 and IC'2. The main induction coils IC are relatively large in diameter. The auxiliary induction coils IC'1 and IC'2 are relatively small in diameter and are in a relationship in which both ends thereof are inserted into the main induction coils IC.

As shown in FIG. 13B, as for the temperature distribution characteristics of the sixth embodiment, high temperature distribution can be obtained in the area of the heating roller HR directly facing the main induction coils IC, and the temperature distribution is held down to be a little lower than this high temperature in the area directly facing the auxiliary induction coils IC'. And as a heating source of the small-diameter induction coils IC' exists within the spacing 1, it is a little more distant from the heating roller HR than the large-diameter induction coils IC compared to the configuration wherein no heating source (auxiliary induction coils IC') exists among the induction coils IC as in the aforementioned case of taking the spacing 1 in the state of only one layer. If permeability of the heating roller HR is high, however, it is possible to sufficiently heat the heating roller HR by adding the action of the auxiliary induction coils IC' without significant influence on the transmission efficiency of the induction coils IC'. For that reason, it is possible to hold down the temperature difference D to be within the temperature difference D even lower than plus or minus 15 degrees C.

Figure 14:
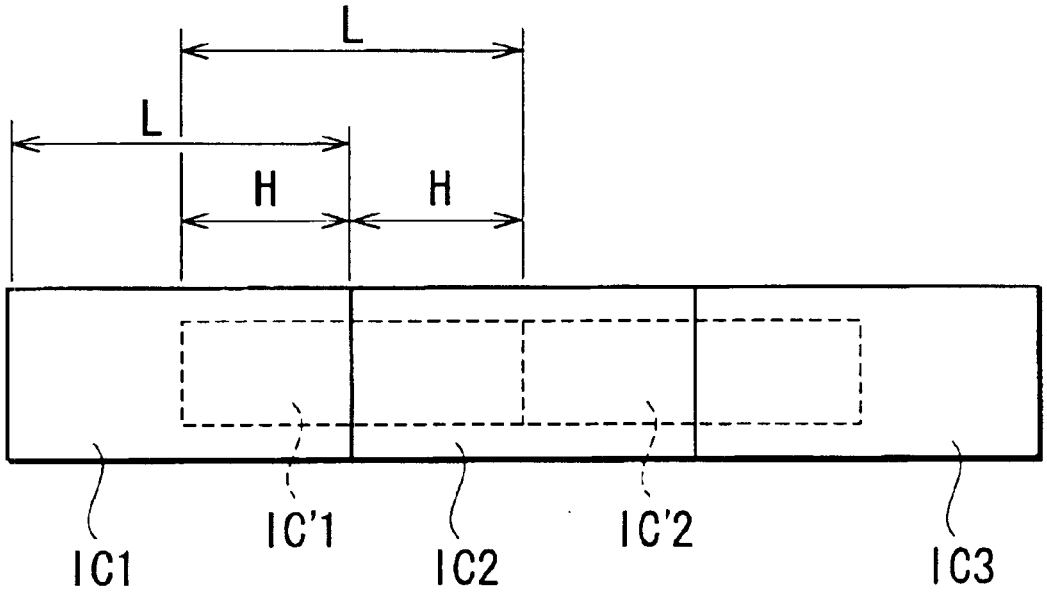
FIG. 14 is a conceptual diagram for explaining an overlapping relationship of the plurality of induction coils and auxiliary induction coils.

As shown in FIG. 14, it is effective to set an overlapping length H of the main induction coils IC and auxiliary induction coils IC' in the axial direction to be ½ or less against the lengths L of the induction coils IC and IC'.

DETAILED DESCRIPTION OF THE PREFERRED EMBODIMENTS

Hereafter, the embodiments of the present invention will be described by referring to the drawings.

Figure 15:
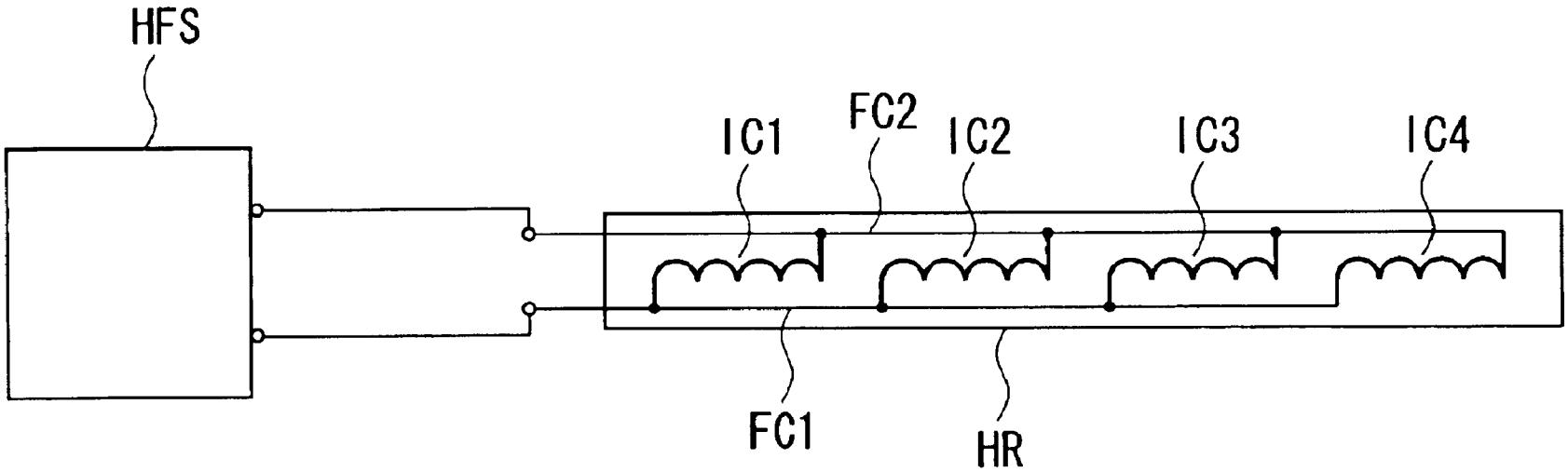
FIG. 15 is a conceptual diagram showing the entirety according to a seventh embodiment of the induction heating roller apparatus according to the present invention.
Figure 16:
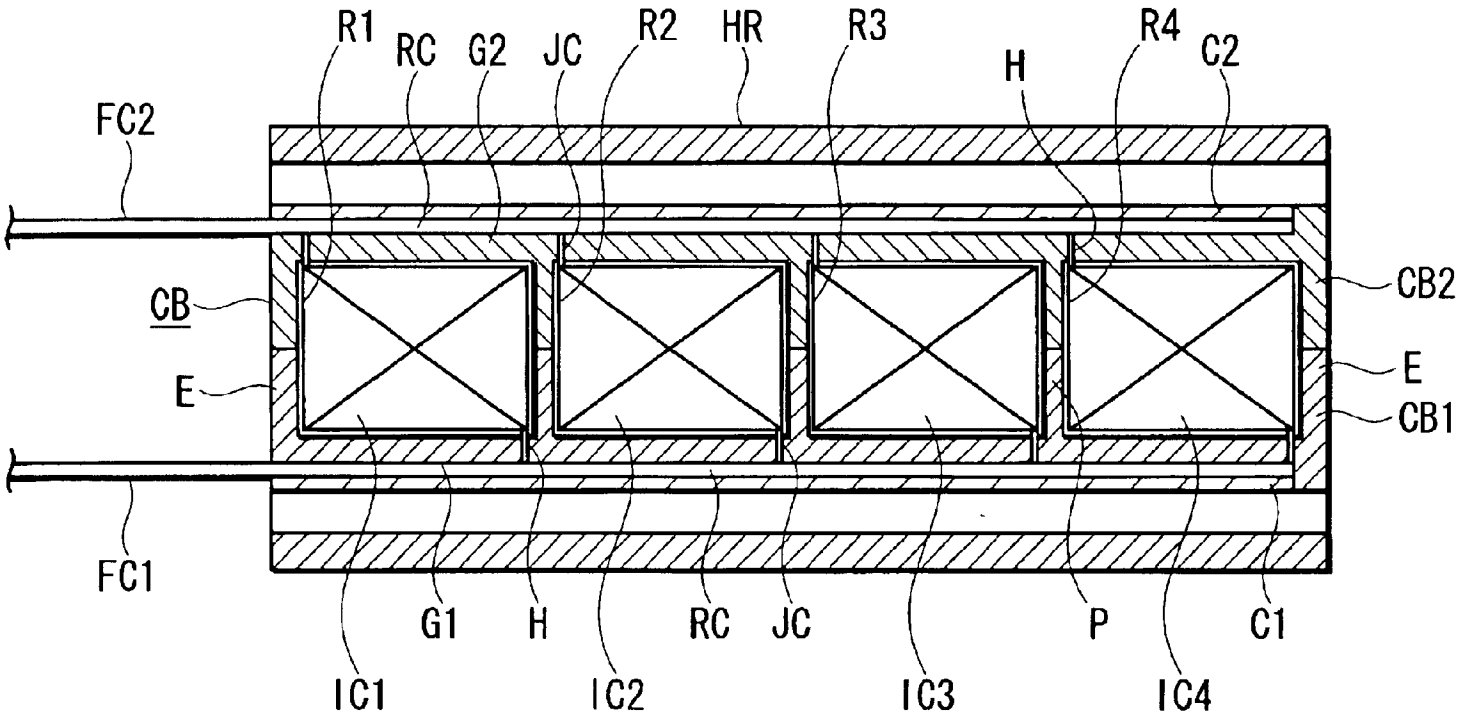
FIG. 16 is a longitudinal section showing the heating roller, induction coils, electric supply lines and coil bobbin.

A seventh embodiment of an induction heating roller apparatus according to the present invention will be described by referring to FIG. 15 to FIG. 17. As shown in FIG. 16, the induction heating roller apparatus according to the present invention has four induction coils IC1 to IC4 and a pair of electric supply lines FC1, FC2 accommodated inside a coil bobbin CB.

Figure 17:
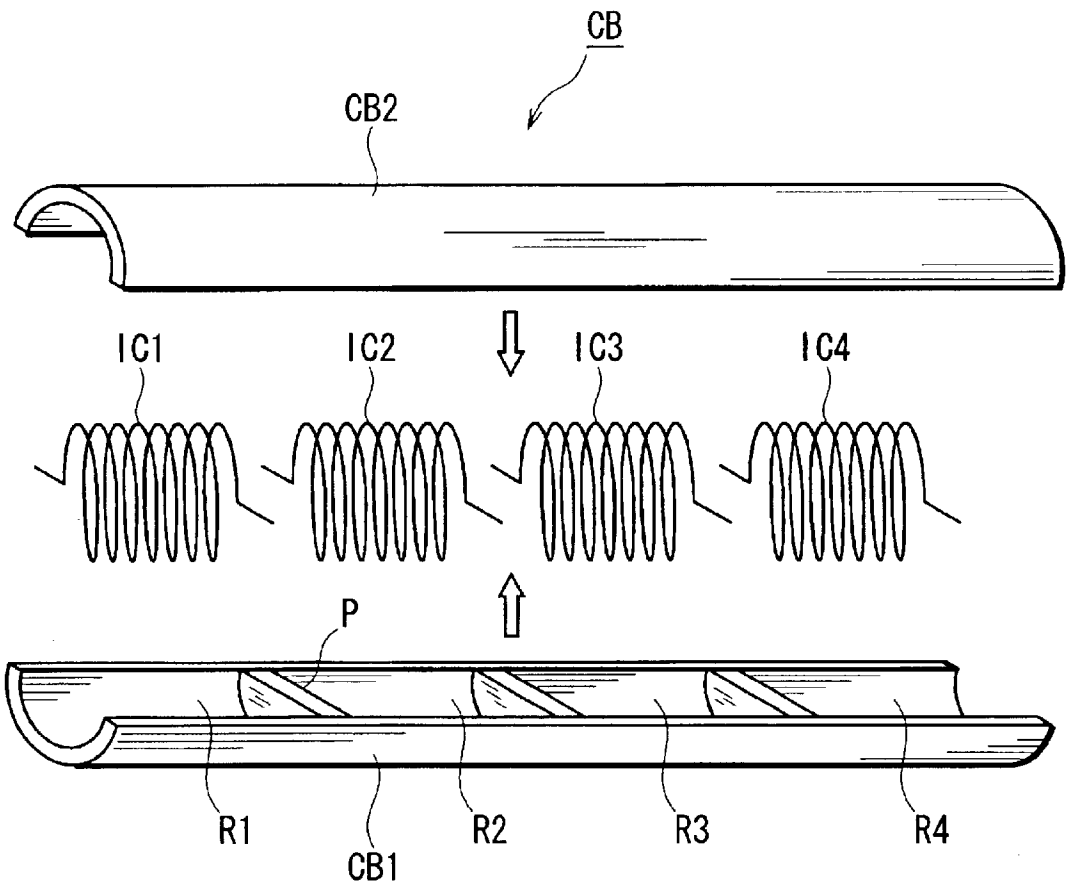
FIG. 17 is an exploded perspective view of the induction coil and coil bobbin.

As shown in FIGS. 16 and 17, the induction coils IC1 to IC4 are mutually adjacent with a small spacing and are accommodated inside the coil bobbin CB described later. The four induction coils IC1 to IC4 are placed in a position opposed to the heating area of the heating roller HR, and are magnetically coupled to the secondary coil ws.

Each of the pair of electric supply lines FC1, FC2 is comprised of a conductive wire RC and a connecting portion JC in a pectinate manner. The pair is clear of each other, and is connected to both ends of the four induction coils IC1 to IC4 supported by the coil bobbin CB described later via the connecting portion JC so as to connect them in parallel. The conductive wire RC is linear. A plurality of connecting portions JC are connected to the conductive wire RC like teeth of a comb.

As shown in FIG. 17, the coil bobbin CB is constituted by integrating two bobbin constituting pieces CB1, CB2 made of ceramics and a pair of covers C1, C2. And it has four coil accommodation rooms R1 to R4, a pair of electric supply line accommodation groove G1, G2 and a communicating hole H. The four coil accommodation rooms R1 to R4 are placed inside the coil bobbin CB, and are electrically isolated by three bulkheads P and end walls E on both ends and adjacently arranged in the longitudinal direction of the coil bobbin CB. The electric supply line accommodation grooves G1, G2 are opened on an outer face of the coil bobbin CB opposed to a radius direction thereof, and are formed to extend in the longitudinal direction. The communicating hole H is communicated between the electric supply line accommodation grooves G1, G2 and the four coil accommodation rooms R1 to R4. The pair of covers C1, C2 adhere to the bobbin constituting pieces CB1, CB2 to block openings of the electric supply line accommodation grooves G1, G2. Moreover, the electric supply line accommodation grooves G1, G2 and the communicating hole H are not shown in FIG. 17.

An eighth embodiment of the induction heating roller apparatus according to the present invention will be described by referring to FIG. 18. This embodiment has the same circuit configuration as in FIG. 1. And of the four electric supply lines FC0, FC1, FC2 and FC3 in FIG. 1, the electric supply line FC0 is connected in common to one end of each of the three induction coils IC1, IC2 and IC3, and is also connected to the stable potential side of an output terminal of a high frequency power supply HFS via induction coil selection means F1, F2 and F3. The electric supply line FC1 is connected to the other end of the induction coils IC1. Likewise, the electric supply line FC2 is connected to the other end of the induction coil IC2, and FC3 is connected to the other end of the induction coil IC3 respectively.

Figure 18:
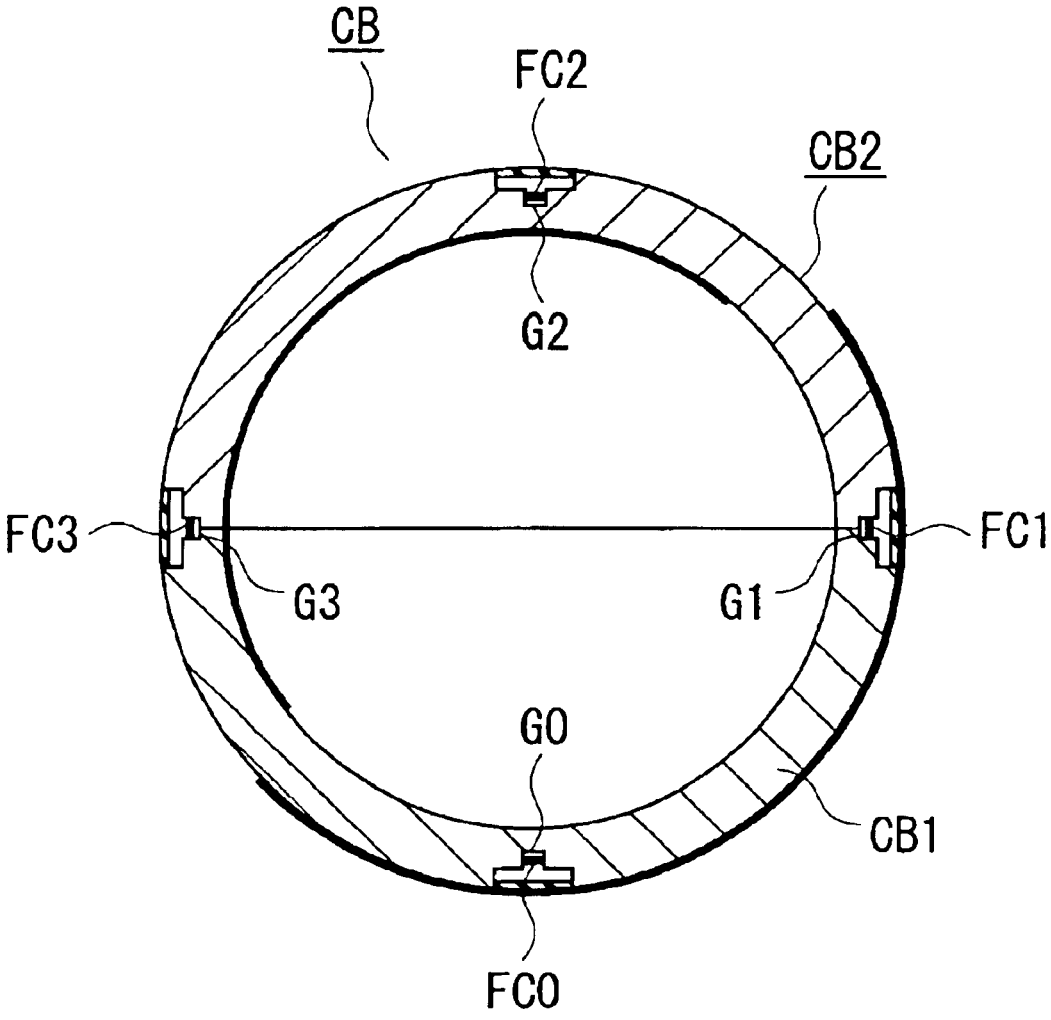
FIG. 18 is a cross-sectional view of the coil bobbin and electric supply line according to an eighth embodiment of the induction heating roller apparatus according to the present invention.

As shown in FIG. 18, the coil bobbin CB has the four electric supply line accommodation grooves G0, G1, G2 and G3 placed with a 90-degree spacing on the outer face thereof. And the electric supply lines FC0, FC1, FC2 and FC3 having the same number at the end of the symbols are accommodated therein respectively.

Figure 19:
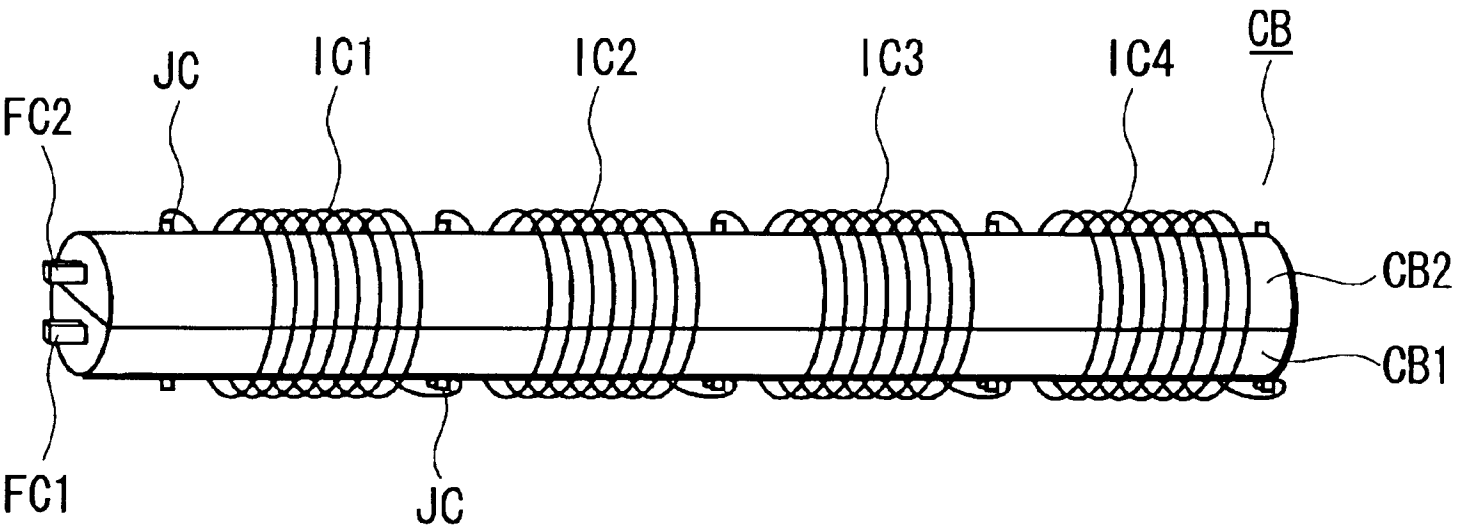
FIG. 19 is a perspective conceptual diagram showing the plurality of induction coils, electric supply lines and coil bobbin according to a ninth embodiment of the induction heating roller apparatus according to the present invention.
Figure 20:
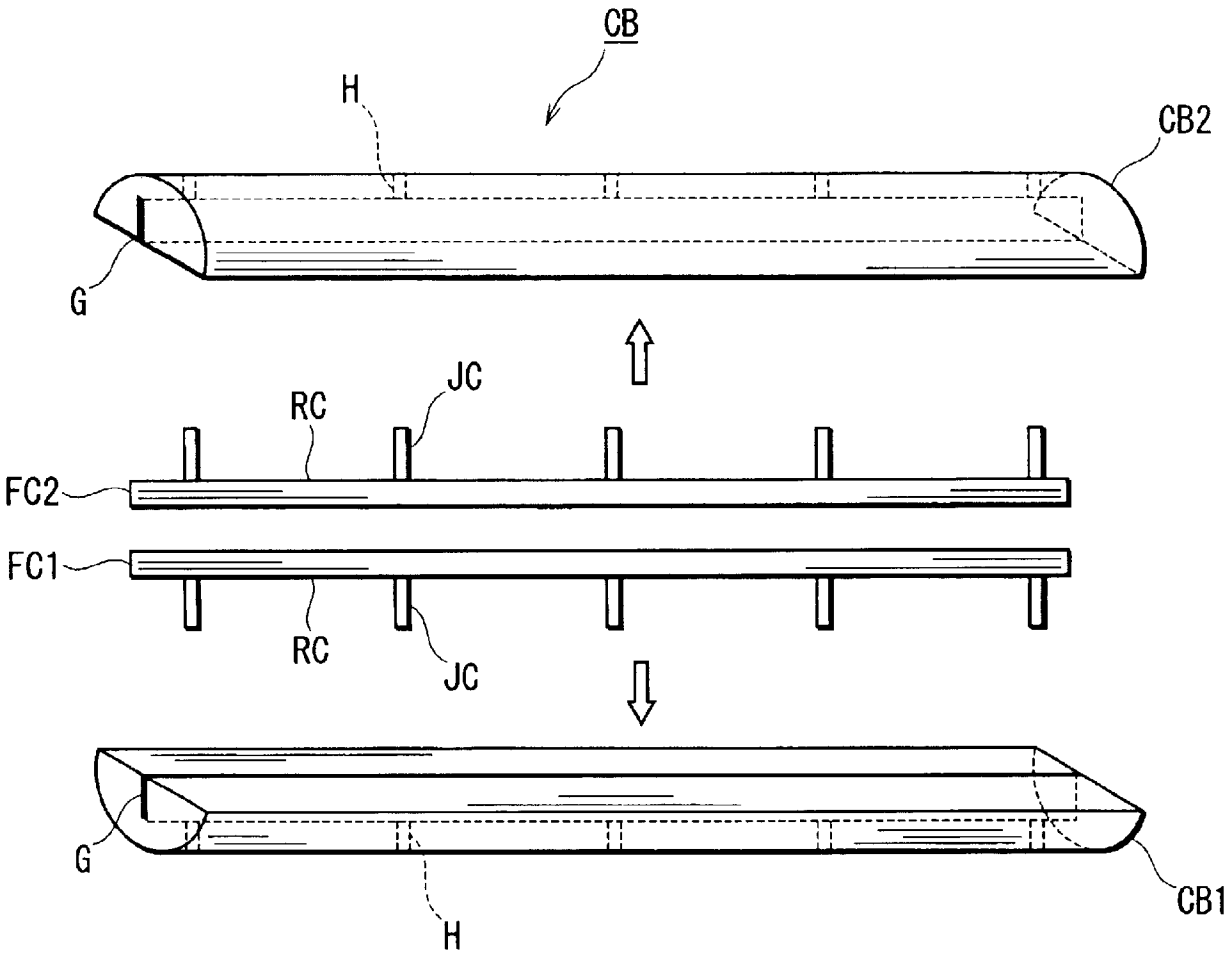
FIG. 20 is an exploded perspective view of the coil bobbin and electric supply line.

A ninth embodiment of the induction heating roller apparatus according to the present invention will be described by referring to FIGS. 19 and 20. This embodiment has the induction coils IC placed on the outer face of the coil bobbin CB, and also has the pair of electric supply lines FC1, FC2 accommodated inside the coil bobbin CB. To be more specific, the coil bobbin CB has its bobbin constituting pieces CB1, CB2 forming a solid semi-cylinder and equipped with the electric supply line accommodation groove G on the juncture side respectively. In addition, the communicating hole H is communicated between the outer face of the coil bobbin CB and the electric supply line accommodation groove G.

When the bobbin constituting pieces CB1, CB2 are in a separate state, the electric supply lines FC1, FC2 fit the electric supply line accommodation groove G, and the tips of the connecting portions JC jut out of the communicating hole H to the outside.

The induction coils IC1, IC2 and IC3 are supported by the coil bobbin CB in the outer region of the coil bobbin CB, and both ends thereof are connected to the connecting portions JC of the electric supply lines FC1, FC2.

Figure 21:
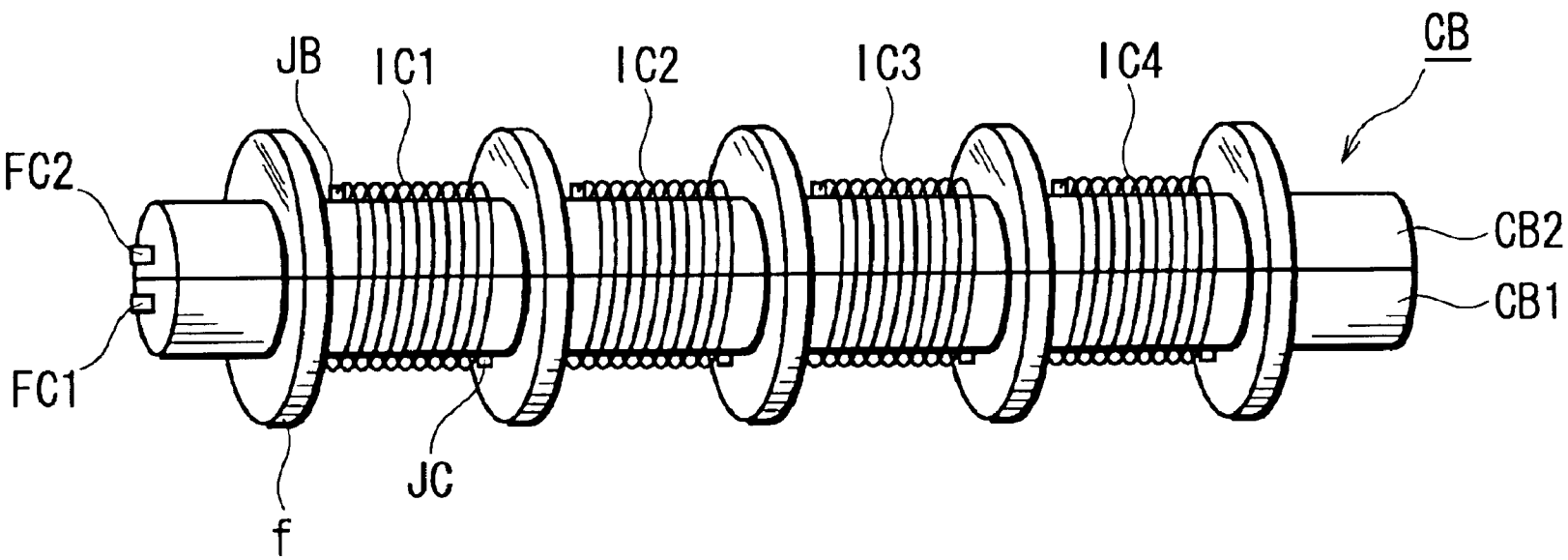
FIG. 21 is a perspective view showing the plurality of induction coils, electric supply lines and coil bobbin according to a tenth embodiment of the induction heating roller apparatus according to the present invention.

A tenth embodiment of the induction heating roller apparatus according to the present invention will be described by referring to FIG. 21. This embodiment has an insulating collar fF integrally formed among the adjacent induction coils IC on the outer face of the coil bobbin CB.

Figure 22:
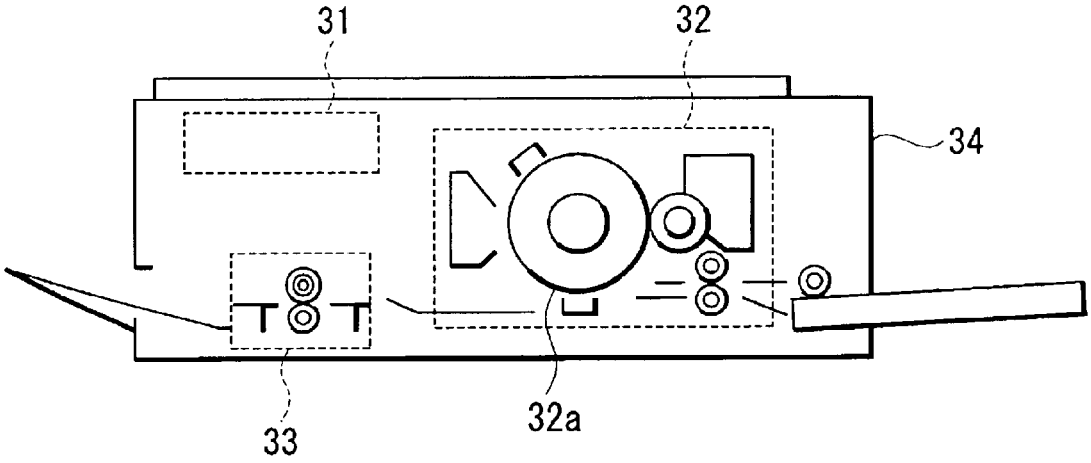
FIG. 22 is a schematic cross-sectional of a copy machine serving as an image formation apparatus according to the present invention.

A copying machine as an embodiment of the image formation apparatus according to the present invention will be described by referring to FIGS. 22 and 23. In FIG. 22, reference numeral 31 denotes a reader, 32 denotes image formation means, 33 denotes a fixing apparatus and 34 denotes an image formation apparatus case.

The reader 31 forms an image signal by optically reading an original sheet of paper.

The image formation means 32 forms an electrostatic latent image on a photosensitive drum 32*a* based on the image signal, and adheres toner to this electrostatic latent image to form a reverse image which is printed on a record medium such as paper so as to form the image.

Figure 23:
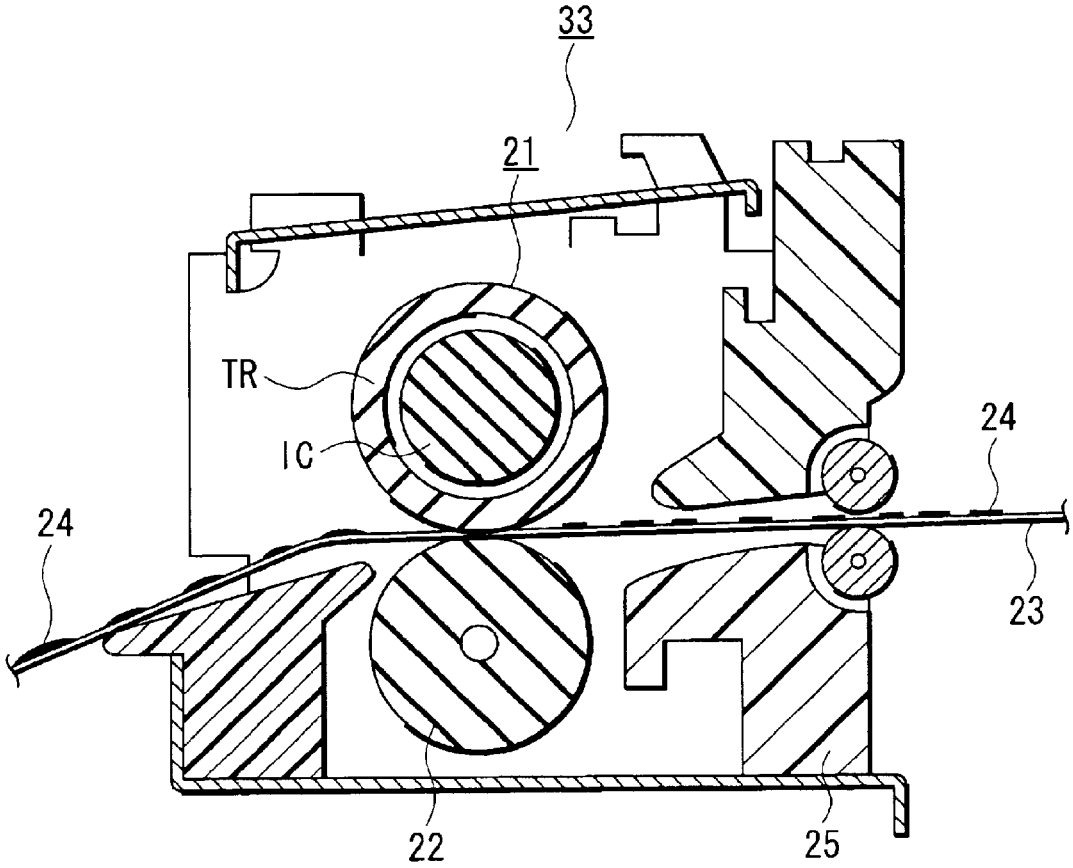
FIG. 23 is a longitudinal section of a fixing apparatus.
Figure 24A:
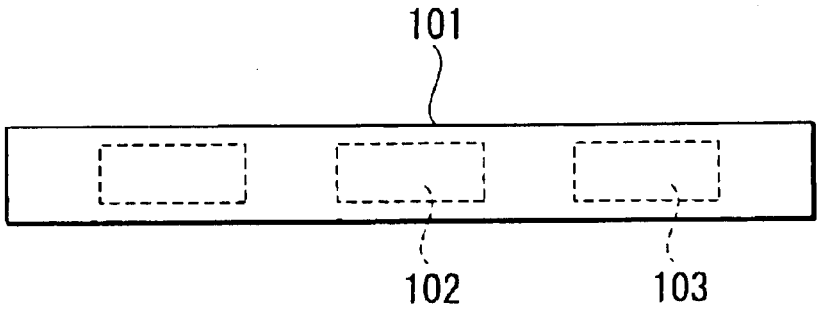
FIG. 24 is a diagram for explaining a relative layout and the temperature distribution of the heating roller and induction coils of a related art.
Figure 24B:
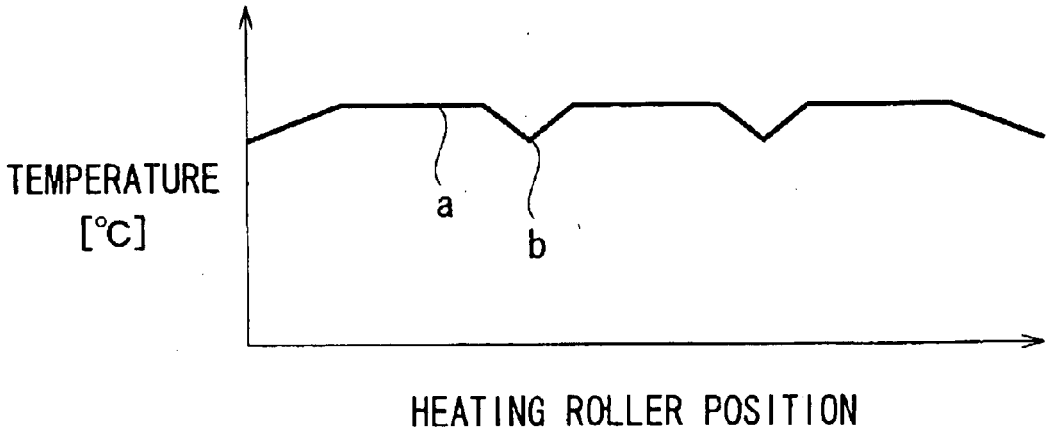
(PRIOR ART) FIG. 24(b)

As shown in FIG. 23, the fixing apparatus 33 is constituted by having an induction heating roller apparatus 21, a pressure roller 22 and a mount 25. As for the induction heating roller apparatus 21, the embodiments of the induction heating roller apparatus described above may be used. The pressure roller 22 is placed in a pressure welding relationship with the heating roller HR of the induction heating roller apparatus 21, and carries a record medium 23 tightly sandwiched between them. Moreover, the record medium 23 has the image formed by having a toner 24 adhered on the surface thereof. The mount 25 has the above components (except the record medium 23) installed in a predetermined positional relationship.

And as for the fixing apparatus, the record medium 23 having the toner 24 adhered thereon and the image formed is inserted between the heating roller HR of the induction heating roller apparatus 21 and the pressure roller 22 to be carried, and the toner 24 is heated and melted by receiving heat of the heating roller HR so that heat fixing is performed.

The image formation apparatus case 34 accommodates the above apparatuses and the means 31 to 33, and is also equipped with a carrying apparatus, a power supply apparatus, a control apparatus and so on.

We claim:

1. An induction heating roller apparatus wherein:

a heating roller for generating heat;

a plurality of induction coils placed in a dispersed state in an axial direction inside the heating roller and also set in a relationship in which adjacent ones are in mutually reversed winding directions and generated flux has the same polarity, wherein the plurality of induction coils are wound around an inside circumference of the heating roller; and a high frequency power supply for supplying high frequency power to the plurality of induction coils, the heating roller being heated with an induction current by being magnetically coupled to at least one of the plurality of induction coils when the at least one induction coil receives the high frequency power.

2. The induction heating roller apparatus according to claim 1, wherein the plurality of induction coils form a plurality of groups comprised of a plurality of induction coils respectively and each of the groups is connected to a different output terminal of the high frequency power supply via an independent electric supply line.

3. The induction heating roller apparatus according to claim 1, wherein each of the plurality of induction coils is connected to the high frequency power supply via a common electric supply line.

4. The induction heating roller apparatus according to claim 1, wherein there is a spacing of 2 mm or less between the adjacent induction coils.

5. The induction heating roller apparatus according to claim 1, wherein:

an electric supply line extended in the axial direction inside the heating roller and connected to the induction coils to feed power to the plurality of induction coils; and a coil bobbin mainly comprised of a plurality of bobbin constituting pieces divided in the axial direction and accommodating at least one of the induction coil and electric supply line therein to support the induction coil and electric supply line are provided.

6. An image formation apparatus, comprising image formation means for forming a toner image on a record medium; and a fixing apparatus for fixing the toner image on the record medium, the fixing apparatus including a pressure roller and the induction heating roller apparatus according to claim 1 placed to fix the toner image with a heating roller placed to be facing the pressure roller in a pressure welding relationship while carrying the record medium having the toner image formed thereon sandwiched between the pressure roller and the heating roller.

* * * * *